United States Patent [19]

Vydrin et al.

[11] 4,202,197

[45] May 13, 1980

[54] DEVICE FOR CONTROLLING THE THICKNESS OF STRIP STOCK BEING ROLLED

[75] Inventors: Vladimir N. Vydrin; Vladimir G. Dukmasov; Garifulla Davlyatshin; Sergei L. Kuznetsov, all of Chelyabinsk, U.S.S.R.

[73] Assignee: Chelyabinsky Politekhnichesky Institut, Chelyabinsk, U.S.S.R.

[21] Appl. No.: 864,012

[22] Filed: Dec. 23, 1977

[51] Int. Cl.[2] ..... B21B 37/12

[52] U.S. Cl. ..... 72/245

[58] Field of Search ..... 72/245, 237, 6–8, 72/20, 21, 240

[56] References Cited

U.S. PATENT DOCUMENTS

| | | | |
|---|---|---|---|
| 3,075,417 | 1/1963 | Blain | 72/240 X |
| 3,333,453 | 8/1967 | Guillot | 72/6 |
| 3,496,743 | 2/1970 | Stone | 72/8 |
| 4,083,213 | 4/1978 | Vydrin et al. | 72/6 |

*Primary Examiner*—Milton S. Mehr
*Attorney, Agent, or Firm*—Lackenbach, Lilling & Siegel

[57] ABSTRACT

The device proposed herein incorporates the following components located on both sides of the roll mill stand: hydraulic dynamometers for absorbing the rolling force; hydraulic cylinders for creating and exerting the adjusting force; and valves for oil pressure control in the hydraulic cylinder interior. The hydraulic dynamometers are situated between the supports of one of the rolls and the roll mill stand housing and the hydraulic cylinders are interposed between the supports of the other roll and the roll mill stand housing.

The interior spaces of said cylinder and the dynamometer communicate with pumping units that deliver oil thereto so as to build up a pressure in the spaces which is in excess of the rolling force. The valves regulate the pressure effective in the hydraulic cylinder interior in direct proportion to the rolling force and the deforming force of the elastic members of the device.

16 Claims, 17 Drawing Figures

DEVICE FOR CONTROLLING THE THICKNESS OF STRIP STOCK BEING ROLLED

FIELD OF THE INVENTION

The present invention relates generally to plastic metal working and, more specifically, to a method of controlling the thickness of strip stock being rolled and to a device for effecting said method.

The invention can find utility when applied in rolling mills for producing sheet and band stock, standard and shaped sections, as well as pipes and tubes.

DESCRIPTION OF THE PRIOR ART

Known in the art are some methods of controlling the outgoing thickness (also termed height) $h_1$ of the strip rolled stock, and devices for carrying said methods into effect, based upon traversing the chock of one of the rolls in the course of the stock thickness control process, by means of power-assisted devices, the length of the traverse of said roll chock corresponding to the magnitude of the variations of the roll mill stand elastic deformation.

The essence of said known methods will hereinafter be discussed with reference to an exemplary method as disclosed in British Pat. No. 1,194,328 IPC B21b, 13/14. The abovesaid embodiment of the known method most closely resembles the method proposed herein and is therefore taken as the prototype.

The aforesaid known method resides in the following.

A force is established to urge the roll support to traverse, said force being in excess of the force of rolling.

Said force is so applied to the roll support that it overcomes the force of rolling, the difference between said force and the force of rolling causing the roll support to traverse.

Another force proportionate to said traversing force is developed to prevent the supports of the rolls, between which the strip stock is deformed, from moving towards each other and to balance the difference between the force traversing the roll supports and the force of rolling.

By changing the force traversing the roll supports according to the signal of the error resulting from comparing the signals proportionate to the stand deformation and the roll support traversing, the roll supports are traversed until the error signal $\Delta$ becomes equal to zero so as to rule out any effect of the stand deformation upon the outgoing thickness of the strip rolled stock.

Practical realization of said method consists of carrying into effect the following operations.

1. Measuring the deformation ratio of the mill stand under load. This operation is carried out by measuring the force P of rolling (with the use of an electric dynamometer placed under the pressure screws), followed by calculating the strain value $\delta h_1$ of the stand according to the following relation $$\delta h_1 = P/k; \quad (1)$$

where k denotes mill stand stiffness factor; and

P stands for the force of rolling.

2. Measuring the mutual displacement of the roll chocks. This operation is effected with the use of a set "dynamometer-and-spring" by measuring the force R developed by the hydraulic cylinder, with the help of the dynamometer and a liquid pressure transducer, followed by calculating the increment $\Delta Q$ of the spring-exerted force Q according to the following relation $$\Delta Q = \Delta R - \Delta P; \quad (2)$$

whereupon the amount of the chock displacement is calculated from the following relation $$\delta h_2 = \frac{\Delta Q}{k_1} = \frac{\Delta R - \Delta P}{k_1}; \quad (3)$$

where $k_1$ denotes spring rate (which may have any but predetermined value); and $\Delta P$ and $\Delta R$ stand for the respective increments of the force of rolling P and the force R of the hydraulic cylinder.

Calculation of the strain ratio $\delta h_1$ from the formula (1) and of the amount of traverse $\delta h_2$ from the formula (3) is carried out on the basis of electric pulses with the help of special electrical devices.

3. The signals proportionate to the strain ratio $\delta h_1$ of the stand and the amount of traverse $\delta h_2$ of the chocks are compared and the difference between them is calculated from the following formulas $$\Delta = \delta h_1 - \delta h_2 = \frac{\Delta P}{k} - \frac{\Delta R - \Delta P}{k_1}; \quad (4)$$

$$\Delta = \Delta P\left(\frac{1}{k} + \frac{1}{k_1}\right) - \Delta R \cdot \frac{1}{k_1} \quad (5)$$

The abovesaid operation is carried out by a special unit for comparison of the corresponding electric pulses as a result of which an electric error signal $\Delta$ is delivered according to the formula (5).

When controlling the thickness $h_1$ of the strip rolled stock, the value increment $\Delta P$ is to be taken off the electric dynamometer placed under the pressure screw, and the value of increment $\Delta R$, from the electric pressure transducer is provided on the intake manifold feeding power fluid to the hydraulic cylinder interior. Shaped in a special electric unit are electric pulses which are in effect the summands $$\Delta P\left(\frac{1}{k} + \frac{1}{k_1}\right) \text{ and } \Delta R \cdot \frac{1}{k_1},$$

which are then added in an adder according to the formula (5) to produce the error signal $\Delta$. Then the error signal $\Delta$ is amplified and delivered to the control circuit of the electrohydraulic servovalve.

Depending on the magnitude of the error signal $\Delta$ the electrohydraulic servovalve controls the rate of feed of power fluid from a source of constant pressure to the interior of the hydraulic cylinder extablishing the force R which causes the chock of the movable roll to traverse.

Once the error signal $\Delta$ becomes equal to zero as a result of the chock traversing, power fluid ceases to be fed to the hydraulic cylinder, the chocks cease to traverse, and the thickness $h_1$ of the strip rolled stock becomes equal to a preset value.

Thus, control of the thickness $h_1$ of the strip rolled stock, according to the known method, boils down to producing electric pulses proportionate to the elastic strain ratio of the stand, traversing the chocks of the movable roll, comparing said signals to each other to obtain the traversing error signals, and displacing the movable roll chocks by a power-assisted device (or mechanical actuator) according to the traversing error signal.

Hence, the process for controlling the thickness $h_1$ of the strip rolled stock, according to the method set forth in the prototype, starts as soon as an error signal $\Delta$ appears, i.e., when a grow-back $\delta h$ of the strip rolled stock occurs, subject to elimination.

The afore-stated fact affects adversely the accuracy of thickness control, i.e., the quality of thickness control system operation.

The afore-discussed known method is carried into effect by a device comprising electric dynamometers located under the pressure screws and adapted for measuring the force P of rolling; hydraulic cylinders communicating with a source of constant pressure and adapted for traversing the supports of one of the work rolls; elastic members (beam, pull-rods, spring) adapted for determining the position of the supports of the roll being displaced; a dynamometer adapted for measuring the effective stress value Q of said elastic members and the force R of the hydraulic cylinder; potentiometers for presetting the size of the roll gap (or opening) $h_o$ when relieved from the force of rolling and the required thickness of the strip rolled stock; an adding circuit adapted to produce an error signal $\Delta$ characterizing the amount of grow-back $\delta h$ of the strip rolled stock; an error signal amplifier; an electrohydraulic servovalve adapted to convert the electric error signal $\Delta$ and controlling the rate of flow of power fluid which is force-fed from a pressure-fluid source.

Emphasis should be placed upon the complexity of the devices effecting these prior art methods, as in said devices the force P of rolling is converted into an electric pulse proportionate to the stand elastic strain ratio, the stress value Q of the elastic members is converted into an electric pulse proportionate to the amount of traversing of the roll supports, and an electric error signal $\Delta$, characteristic of the amount of grow-back $\delta h$ of the strip rolled stock, is converted into the rate of flow (pressure) of power fluid. Moreover, electrohydraulic servovalves are very much sophisticated constructionally and involve a high degree of cleanness of the power fluid (oil) to operate efficiently. This fact affects adversely the operational reliability of the control systems, renders their attendance difficult and increases the cost of control systems.

SUMMARY OF THE INVENTION

It is an object of the present invention to provide a method capable of attaining a higher accuracy of control of strip rolled stock thickness.

It is another object of the present invention to provide a device for effecting said method that increases the accuracy of control of strip rolled stock thickness, is reliable in operation and simple in construction, requires low expenses to be manufactured, makes it practicable to utilize power fluids (oil) featuring the degree of cleanness adopted for conventional hydraulic cylinders, and can be attended by low-skill personnel.

Said objects are accomplished by a method of controlling the thickness of the strip stock rolled between the rolls of a mill stand, wherein an adjusting force is established for moving the supports of one of the rolls. The magnitude of the adjusting force is greater than the rolling force and is applied to the roll supports to overcome the rolling force, the difference between said force and the rolling force causes the roll supports to move. Another force is established proportionate to the amount of said movement so as to prevent the supports of the rolls, between which the strip stock is deformed, from moving towards each other and to balance the difference between said adjusting force and the rolling force. The factor of porportionality between the movement of the roll supports and the balancing force is in a definite predetermined ratio with the mill stand stiffness factor. The adjusting force is changed in the course of strip stock deformation to compensate for the roll gap variation according to the formula $$R = k_2 P,$$

where

R denotes the adjusting force;

P denotes the rolling force; and $k_2$ can be found from the equation:

$$k_2 = \frac{k_1}{k} + 1,$$

where $k_1$ denotes the factor of proportionality between the amount of movement of the roll supports and the balancing force and k denotes the mill stand stiffness factor.

These objects are accomplished by a device for effecting said method located in the roll stand of a mill. The roll stand comprises a roll housing on which a screw-down arrangement and mill rolls with supports accomodated in the side recesses of said housing are mounted. At least one of the rolls is positioned to move in the direction of action of the rolling force. The device consists of two portions situated on both sides of the mill stand and made similarly. Each portion incorporates a dynamometer to absorb the rolling force and at least one hydraulic cylinder, whose interior communicates with a source of pressure fluid for the roll supports to move in the course of the rolling process. Elastic members of said device are arranged in such a way as to absorb the difference between the force developed by the hydraulic cylinder and the rolling force. A valve for governing the pressure of power fluid in the hydraulic cylinder interior is also included. According to the invention, the hydraulic dynamometer has at least one chamber and is located between the supports of one of the rolls and the mill housing. The valve for governing the pressure of power fluid in the hydraulic cylinder interior proportionally to the rolling force comprises a casing accommodating a sliding spool which defines a control chamber communicating with the chamber of the hydraulic dynamometer to establish an enclosed space holding power fluid, and a throttle chamber, communicating with the hydraulic cylinder interior and with the source of power fluid, thus defining a common enclosed space filled with running power fluid.

The rolling force developed during the rolling process is absorbed by the hydraulic dynamometer with the result that a pressure of power fluid proportionate to the rolling force is built up in the hydraulic dynamometer chamber and in the control chamber of the pressure regulating valve, whereby the pumping unit develops a pressure of power fluid effective in the hydraulic cylinder and also proportionate to the rolling force said power fluid pressure developing a force in the hydraulic cylinder proportionate to the rolling force for moving the supports of the movable roll. Part of said force overcomes the resistance to the rolling force, the difference between the force of the hydraulic cylinder and the rolling force effects deformation of said elastic members of the device, whereby the movable roll supports move over a distance equal to the magnitude of said deformation. It is due to the development of such a hydraulic cylinder force that the ratio between the force of deformation of the elastic members of the device and the rolling force is equal to the ratio between said stiffness factor of said elastic members of the device and the stiffness factor of the mill stand elastic members, and that the elastic members of the device are deformed an amount equal in magnitude to the deformation undergone by the mill stand elastic members, whereby any effect of the mill stand deformation upon variation of the thickness of strip stock rolled between the work rolls is eliminated.

This engineering solution effecting the herein-proposed method enables one to dispense with electric and electronic circuits, thus rendering the device constructionally simple and reliable in operation. This device is less expensive to manufacture. Provision is made for the use of power fluids (oil) featuring the degree of cleanness adopted in conventional hydraulic cylinders and for the device to be attended by unskilled personnel.

It is preferable that each of the hydraulic cylinders be provided with an enclosed piston rod space confined within the cylinder barrel, a cover, a piston and a piston rod and be filled with power fluid which establishes, along with the hydraulic cylinder components defining said space, the elastic members of the device determining the position of the movable roll supports, whereby the device can be made more compact.

It is also preferable that the sliding spool of each valve for control of fluid pressure in the hydraulic cylinder interior be stepped so as to form an additional control chamber along with the valve casing, and that said control chamber communicate with the hydraulic cylinder rod space to establish an enclosed space together therewith, filled with power fluid, thus adding to the speed of response of the device and to the accuracy of the roll gap adjustment.

It is also preferable that a spring be provided in the enclosed piston-rod space of the hydraulic cylinder, said spring resting with its ends upon the cylinder piston and cover and establishing, along with the power fluid and the hydraulic cylinder components forming said enclosed piston-rod space and adapted to interact with said spring, the elastic members of the device, thus facilitating proper selection of a required stiffness factor of the elastic members of the device.

It is also preferable that the chamber of the hydraulic dynamometer communicate with the valve control chamber and be combined with the hydraulic cylinder piston-end space, a feature that renders the device simpler and more compact.

It is also preferable that a spring be provided in the piston-end space of the hydraulic cylinder and communicating with the valve control and throttle chambers during the rolling process, said spring resting (under no-rolling conditions) upon the piston and barrel of the hydraulic cylinder and contributing to formation of an oil layer in the piston-end space "b" for engaging the device into operation.

It is also preferable that the device be provided with an additional hydraulic cylinder whose interior communicates with the piston-rod space of the hydraulic cylinder to form an enclosed space along therewith, filled with power fluid, both said space and said fluid constituting an elastic member of the device, which makes it possible to provide the required ratio between the stiffness factors of the elastic members of both the device and the mill stand.

It is also preferable that the piston-end space of the hydraulic cylinder communicate with a source of power fluid pressure through a directional-control sliding spool valve having two end control chambers, one of which communicates with the valve throttle chamber and with the source of fluid pressure, while the other of which communicates with a source of constant pressure, a feature that enables the device to be simplified and more compact.

BRIEF DESCRIPTION OF THE DRAWING

In what follows the device proposed in the present invention is illustrated in a number of exemplary embodiments with reference to the accompanying drawings, wherein.

DETAILED DESCRIPTION OF THE INVENTION

Figure 1:
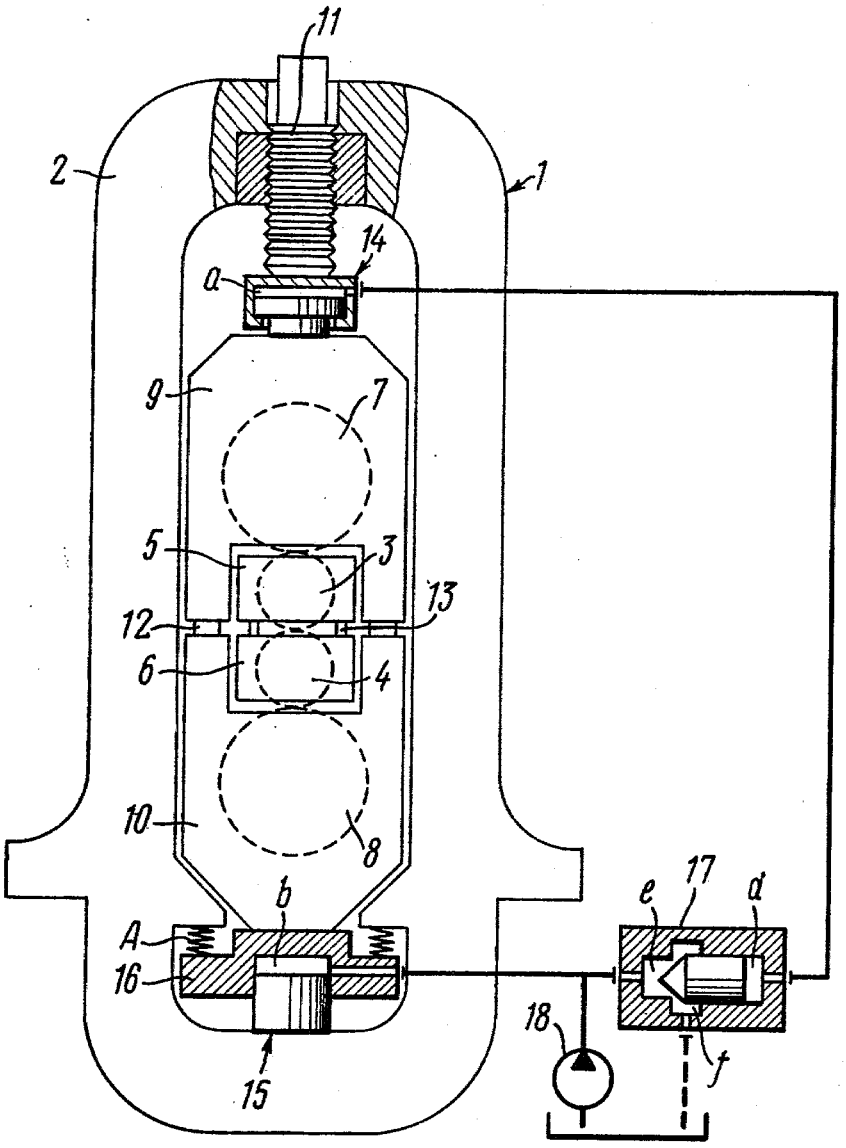
FIG. 1 is an elevational view of a roll mill stand, partially in section, according to the invention.

The herein-proposed method of controlling the thickness of the strip stock being rolled is shown in FIG. 1. The roll mill stand 1 has a housing 2, the side recesses of which accomodate work rolls 3 and 4 adapted to rotate in chocks 5 and 6, deformation of the strip stock occurring between said work rolls. The work rolls 3 and 4 are adapted to interact with backup rolls 7 and 8 which rest, by means of chocks 9 and 10 and a screwdown arrangement 11, in the housing 2. To counterbalance the top work roll 3 and the top backup roll 7 with the respective chocks 5 and 9, hydraulic cylinders 12 and 13 are provided. A hydraulic dynamometer 14 is interposed between the screwdown arrangement 11 and the chock 9 for absorbing the rolling force P. A hydraulic cylinder 15 with a movable barrel 16 is provided for movement of the chocks 10 of the bottom backup roll 8. Provided between the movable barrel 16 and the housing 2 are springs A which develop a balancing force Q for preventing the rolls 3 and 4, between which the strip stock is deformed, from being brought together.

Situated between the hydraulic dynamometer 14 and the hydraulic cylinder 15 is a valve 17 adapted to control the pressure of power fluid fed from a pumping unit 18 to the hydraulic cylinder 15, in proportion of the rolling force P.

When controlling the thickness $h_1$ of the strip stock being rolled by use of the method proposed herein, the rolling force P is absorbed by the fluid (oil) held in the chamber "a" of the hydraulic dynamometer 14 provided between the chock 9 of the top backup roll 7 and the screwdown arrangement 11.

The adjusting force R, which causes the motion of the chock 10 of the bottom (movable) roll 8, is achieved by the hydraulic cylinder 15 whose interior space "b" communicates with a pumping unit 18 which force-feeds the fluid. To satisfy the equation $R=k_2P$, the delivery pressure of the pumping unit 18 and, consequently, the fluid pressure effective in the interior of the hydraulic cylinder 15 are regulated in proportion to the rolling force P by virtue of the valve 17. To this end the control chamber "d" of the valve 17 communicates with the chamber "a" of the hydraulic dynamometer 14 and the throttle chamber "e" of that valve communicates with the interior space "b" of the hydraulic cylinder 15 and with the pumping unit 18.

When strip stock is being rolled, a fluid pressure q is built up in the control chamber "d" of the valve 17 to a value $$q=p/f_a \tag{6}$$

where $F_a$ denotes the area of the piston of the hydraulic dynamometer 14.

The pressure q actuates the sliding spool of the valve 17 so that a fluid pressure $q_1$ is developed in the throttle chamber "e" equal to $$q_1=q\cdot k_3; \tag{7}$$

where $k_3$ stands for the boost pressure ratio of the valve 17.

As an adjusting result, the hydraulic cylinder 15 develops a force equal to $$R=q_1\cdot F_b; \tag{8}$$

where $F_b$ is the area of the hydraulic cylinder piston-end space. Substituting the values of the pressures q and $q_1$ as taken from expressions (6) and (7) to equation (8) one can find the following relationship between the forces R and P.

$$R = k_3\cdot\frac{F_b}{F_a}\cdot P = k_2P. \tag{9}$$

According to the herein-proposed method the parameters of the hydraulic dynamometer 14, the hydraulic cylinder 15 and the valve 17 are so selected as to obey the following expression $$k_2 = k_3\cdot\frac{F_b}{F_a} > 1, \tag{10}$$

so that the adjusting force R is in excess of the rolling force P by the value $(k_2-1)\cdot P$. As a result, when the rolling force P is increased by $\Delta P$ the force R overcomes the force P and brings together the chocks 5 and 6 of the rolls 3 and 4, thus compensating for the elastic deformation of the roll mill stand 1 accounted for by the variation of the rolling force by $\Delta P \leqq O$. When the rolling force P decreases by the value $\Delta P \leqq O$ the regulation process proceeds in a similar way, but in the opposite direction.

The balancing force Q preventing the supports of the rolls 3 and 4 from being brought together is established by, for example, a set of springs A arranged between the movable barrel 16 of the hydraulic cylinder and the roll housing 2, due to the compression of said springs resulting from the movement of the movable hydraulic cylinder barrel 16 over a length expressed by the value $\delta h_2$.

With the spring rate of the springs A equal to $k_1$, the balancing force Q of the compression of the springs varies in response to the movement of the chocks 10 of the rolls 8 over a length $\delta h_2$ to obey the following relation $$Q=k_1\cdot\delta h_2. \tag{11}$$

With a view to eliminating any effect of elastic strain of the roll mill stand 1 upon the strip stock thickness $h_1$, the constant $k_2$ should be equal to $$k_2=(k_1/k)+1 \tag{12}$$

The balancing force Q of deformation of the springs A proceeding from a static equilibrium of the movable barrel 16 of the hydraulic cylinder 15 is determined with no account for losses for friction in the movable components thereof according to the relation $$Q=R-P=(k_2-1)P \quad (13)$$

One can find the amount of movement of the chocks 10 of the movable roll 8 using the following expression $$\delta h_2 = \frac{R-P}{(k_2-k_1)\cdot k} = \frac{P}{k} = \delta h_1 \quad (14)$$

Thus, according to the method proposed herein the chocks 10 always move, in the course of the thickness control process, a distance equal to the magnitude of deformation $\delta h_1$ of the roll mill stand 1, whereby the strip thickness $h_1$ remains unaffected during any fluctuations of the rolling force P.

The essential object of the invention, i.e., an increased accuracy of strip stock thickness control in the course of its deformation attained due to the provision of a simpler and cheaper device, is accomplished as follows.

Any variation of the rolling force P as a result of, for example, changed physico-chemical characteristics of the strip stock being rolled and, hence, a change of the force $R=k_2P$ developed by the hydraulic cylinder 15, causes the chocks 10 of the bottom backup roll 8 to move, this movement occurring concurrently with the deformation of the roll mill stand 1, the values of both being equal to each other. It is due to this fact that the strip stock thickness $h_1$ remains invariable, i.e., the grow-back value $\delta h$ equaling zero throughout the strip length.

Given hereinbelow are some exemplary embodiments of the proposed method. Inasmuch as the device comprises two portions made to the same pattern, only one portion of the device is considered in the present disclosure and illustrated in the accompanying drawings; it is located on the side of the roll mill stand 1 which incorporates, as has been mentioned hereinbefore, the roll housing 2 (FIG. 2) whose side recesses accomodate the work rolls 3 and 4 rotating in the chocks 5 and 6, and is adapted to deform the strip stock therebetween. The work rolls 3 and 4 interact with the backup rolls 7 and 8 which rest upon the roll housing 2 by means of the chocks 9 and 10 and the screwdown arrangement 11. To balance the top work roll 3 and the top backup roll 7 with the chocks 5 and 9 the hydraulic cylinders 12 and 13 are provided.

The device for controlling the thickness of the strip stock being rolled consists of a number of units.

Figure 2:
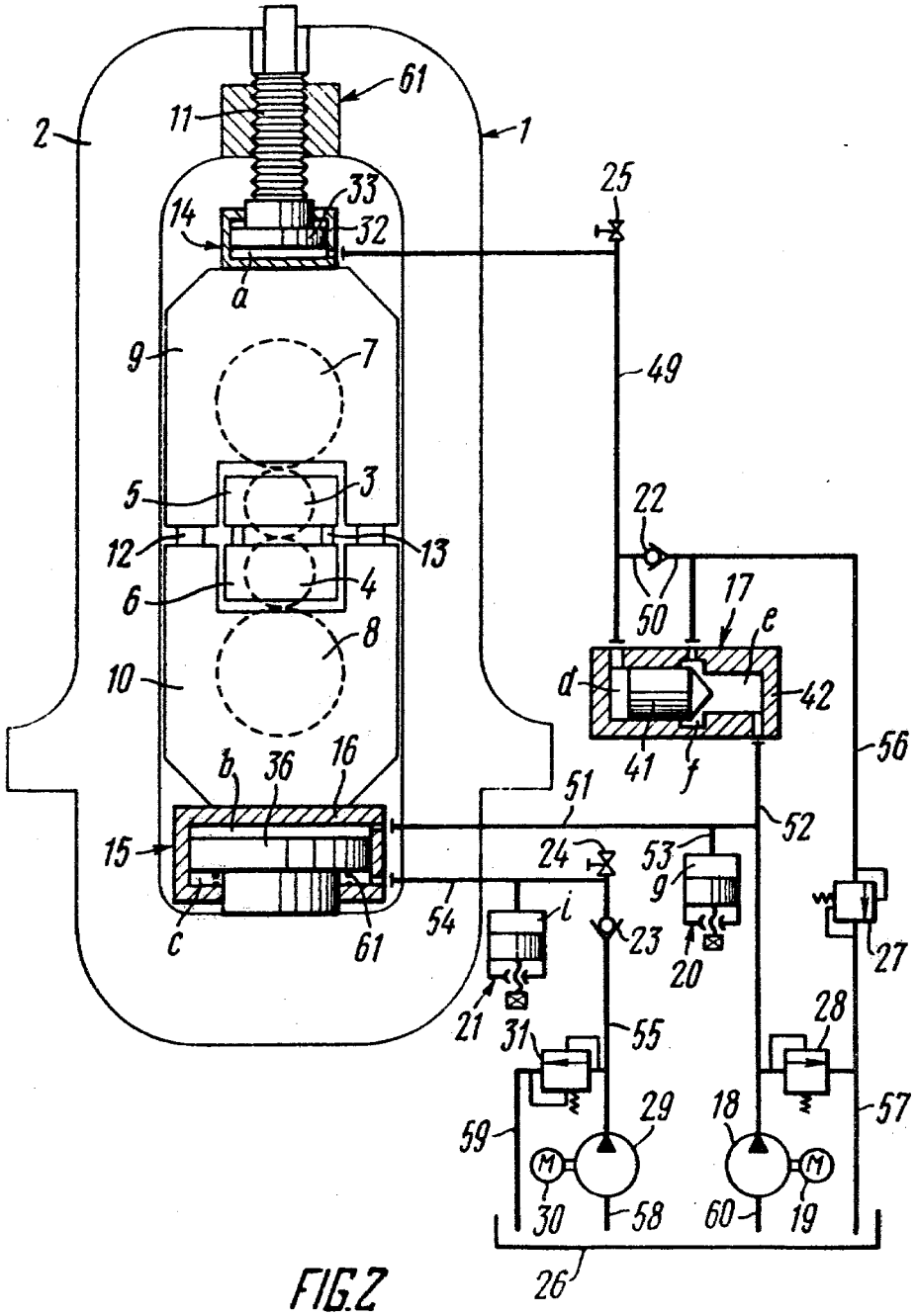
FIG. 2 is an elevational view of a roll mill stand as viewed from the operator's side, partially in section, showing the device for controlling the thickness of the strip stock being rolled between rolls, made according to the invention.

The hydraulic dynamometers 14 has the chamber "a" filled with a fluid to absorb the rolling force P, for which purpose it is interposed between the pressure screw 11 and the chock 9 of the backup roll 7 (FIG. 2). The double-space hydraulic cylinder 15 is located on the roll housing 2 under the chock 10 of the backup roll 8, said cylinder having the piston-end space "b" for generating the adjusting force R for movement of the chock 10 along with the rolls 4 and 8, and the enclosed piston-rod space "c" filled with the fluid and adapted for developing the balancing force Q preventing the movable barrel 16 of the hydraulic cylinder 15 from moving.

Provided between the hydraulic dynamometer 14 and the hydraulic cylinder 15 is the valve 17 for regulating the pressure (flow-rate) of the fluid fed from the pumping unit 18, powered by a motor 19, to the piston-end space "b" of the double-space hydraulic cylinder 15, said valve 17 having a control chamber "d", a throttle chamber "e" and a drainback chamber "f".

The device also comprises volumetric oil regulators 20 and 21 whose chambers "g" and "i" communicate respectively with the piston-end space "b" and the piston-rod space "c" of the hydraulic cylinder 15. These regulators determine the stiffness factor $k_1$ of the members of the device (which are hereinafter more precisely defined) in correspondence with the stiffness factor k of the roll mill stand.

Provision is made in the hydraulic pipings of the device for check valves 22 and 23, stop valves 24 and 25 for air or oil to escape into a tank 26, a valve 27 (one for both sides of the roll mill stand 1) for restricting the minimum pressure developed by the pumping unit 18, and a pressure relief valve 28 to restrict the maximum pressure developed by the pumping unit 18. Common to both sides of the roll mill stand 1 are an oil tank 26, a pumping unit 29 with a motor 30 and a valve 31 for keeping a constant preliminary pressure in the spaces "c" of the hydraulic cylinders 15.

The hydraulic dynamometer 14 (FIG. 3) has a casing 32 with a piston 33 and a cover 34 held by screws 35 to the casing 32. The casing 32 and the piston 33 establish the chamber "a" communicated with a port "$a_1$" provided in the casing 32. Hermetic tightness of the chamber "a" is effected by seals (not shown). The hydraulic dynamometer 14 (FIG. 2) provided between the screwdown arrangement 11 and the chock 9 is adapted to interact with the screwdown arrangement 11 with its piston 33 and with the chock 9 of the top backup roll 7 with its casing 32.

The hydraulic cylinder 15 (FIG. 4) has the barrel 16 with a piston 36 and a cover 37 held to the barrel 16 by screws 38. The piston 36 and the barrel 16 define the piston-end space "b", and the piston 36, the barrel 16, the cover 37 and a rod 39 of the piston 36 define the piston-rod space "c". The spaces "b" and "c" communicate with ports "$b_1$" and "$c_1$", respectively. The spaces "b" and "c" are hermetically sealed by virtue of seals (not shown). The hydraulic cylinder 15 (FIG. 2) is mounted under the chock 10 of the bottom backup roll 8 so as to interact with the chock 10 of the bottom backup roll 8 with its barrel 16, and with the roll housing 2 with the piston 36.

The valve 17 (FIG. 5) has a casing 40 with a sliding spool 41 and a cover 42 held to the casing 40 by screws 43. The sliding spool 41 and the casing 40 define the control chamber "d"; the sliding spool 41 and the casing 40 define the throttling gap "y" and the throttle chamber "e"; the sliding spool 41, the casing 40 and the cover 42 define the drainback chamber—"f". Said chambers d, e and f communicate respectively with ports $d_1$, $e_1$, and $f_1$, and are hermetically sealed by seals (not shown).

Figure 6:
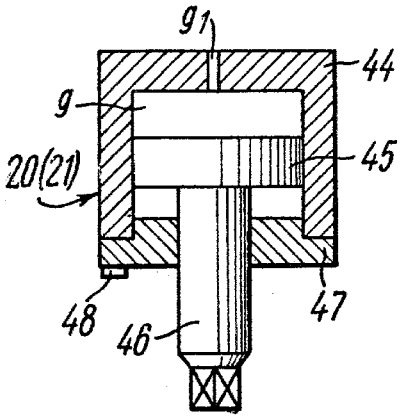
FIG. 6 is an enlarged sectional view of the volumetric oil regulator, taken in an axial plane thereof.

The volumetric oil regulators 20 and 21 (FIG. 6) are similar in construction, each having a casing 44 accomodating a piston 45 with a screw rod 46 and a cover 47 held to the casing 44 by screws 48. The piston 45 and the chest 44 define a chamber "g" communicating with the port "$g_1$" and hermetically sealed by seals (not shown).

All the remaining units of the device, viz., the valves 27 (FIG. 2) and 31, the stop valves 24 and 25, the check valves 22 and 23, the pressure relief valve 28, the pumping units 29 and 18 with the motors 30 and 19, and the tank 26 are commonly adopted in industrial practice; therefore, they are beyond the scope of the present disclosure and need not be described in detail.

Hydraulic communication of all the units based on the roll mill stand 1 of the herein-proposed device is effected as follows.

The chamber "a" of the hydraulic dynamometer 14 (FIG. 2) communicates through hydraulic piping 49 with the control chamber "d" of the valve 17. In order to be filled with oil said chambers "a" and "d" communicate through hydraulic piping 50 and the check valve 22 with the drainback chamber "f" of the valve 17. When the device is being operated, said chambers "a" and "d" establish an enclosed space, wherein oil pressure is proportionate to the rolling force P and pressure is applied to the sliding spool 41 of the valve 17 from the side of the control chamber "d".

The piston-end space "b" of the hydraulic cylinder 15 communicates simultaneously with the pumping unit 18 and with the throttle chamber "e" of the valve 17 through respective hydraulic pipings 51 and 52. Pressure in said space "b" and said chamber "e" is built up by virtue of hydraulic resistance to the flow of oil from the chamber "e" through the gap "y" to the drainback chamber "f" of the valve 17. Said pressure actuates the sliding spool 41 from the side of the chamber "e" to balance the pressure applied to the sliding spool 41 from the side of the chamber "d". To change the stiffness factor of the double-space hydraulic cylinder 15 and, consequently, the stiffness factor "k" of the roll mill stand 1, the piston-end space "b" of said cylinder communicates, through hydraulic pipings 51 and 53, with the chamber "g" of the volumetric oil regulator 20.

The piston-rod space "c" of the double-space hydraulic cylinder 15 communicates, through hydraulic piping 54, with the chamber "i" of the volumetric oil regulator 21. In order to be filled with oil said space "c" and said chamber "i" communicate, through hydraulic piping 55 and the check valve 23, with the pumping unit 29. With the device operative, said space "c" and said chamber "i" define the enclosed space, wherein an oil pressure is proportionate to the amount of movement of the barrel 16 of the double-space hydraulic cylinder 15.

The components of the double-space hydraulic cylinder 15, the volumetric oil regulator 21, along with the hydraulic piping 54, constituting said enclosed space, as well as and the oil contained therein, establish a group of the elastic members of the device during its operation and feature the stiffness factor $k_1$.

The drainback chamber "f" of the valve 17 communicates via hydraulic pipings 56 and 57, with the tank 26. To build up a constant initial pressure $q_1$ in an enclosed space defined by a chambers "a" and "d", the valve 27 is provided in the oil return line between the hydraulic pipings 56 and 57.

The device is adjusted in the following way.

An initial pressure is built up in the units of the device by switching on the motors 30 and 19, thereby actuating the pumping units 29 and 18. Oil is gravity-fed to the pumping unit 29 from the oil tank 26 along hydraulic piping 58 and is delivered along the hydraulic piping 55 through the check valve 23 at a pressure $q_o$ into the enclosed space formed by the space "c" and the chamber "i", the pressure $q_o$ being set by the valve 31 and kept thereby always constant. The surplus oil is drained back through the valve 31 and is returned along a hydraulic piping 59 to the oil tank 26. Whenever necessary, air or oil from said spaces, chambers and hydraulic pipings is allowed to escape to the tank 26 along hydraulic piping (not shown) upon opening the stop valve 24.

Oil is gravity-fed from the tank 26 to the pumping unit 18 along piping 60 and is delivered along hydraulic pipings 52 and 51 to the piston-end space "b" of the double-space hydraulic cylinder 15 and to the throttle chamber "e" of the valve 17. Then it flows through the gap "y" between the sliding spool 41 and the cover 42 to the drainback chamber "f" and from there oil passes along hydraulic pipings 56 and 50 and through the check valve 22 to the enclosed space formed by the chambers "a" and "d" and the hydraulic piping 49. The surplus oil is drained back through the valve 27 to return along the piping 57 to the tank 26. Air and oil from said chambers, spaces and hydraulic pipings escape, whenever necessary, to the tank 26 along the hydraulic piping (not shown) upon opening the stop valve 25.

The pressure relief valve 28 is adjusted for the maximum permissible pressure developed by the pumping unit 18.

The pressure value $q_1$ is set by the valve 27 and is to be estimated so as to fix the piston 33 of the hydraulic dynamometer 14 and the piston 36 of the double-space hydraulic cylinder 15 in their initial positions (i.e., before starting the rolling process).

In this connection the pressure value $q_1$ must satisfy the following inequality $$q_o \frac{F_c}{F_b} > q_1 > \frac{N_o}{2 \cdot F_a}; \tag{15}$$

where $N_o$ is the force with which the top backup roll 7 and the top work roll 3 are forced against the hydraulic dynamometer 14 by the hydraulic cylinders 12 and 13;

$F_a$ is the area of the piston 33 of the hydraulic dynamometer 14;

$F_b$ is the area of the piston 36 of the hydraulic cylinder 15 on the side of the space "b"; and $F_c$ is the area of the piston 36 of the hydraulic cylinder 15 on the side of the space "c".

The pressure value $q_o$ corresponds to the lower limit of the rolling force, upon reaching of which the device starts controlling the strip stock thickness.

By changing appropriately the position of the piston 45 (FIG. 6) with respect to the casing 44 of the volumetric oil regulator 20 one can set a required stiffness factor k of the roll mill stand 1 (FIG. 2), which is a function of the elastic behaviour of the roll mill stand 1 and of the units of the device, viz., the hydraulic dynamometer 14 along with the amount of oil contained in the chambers "a" and "d" and in the hydraulic piping 49, and the hydraulic cylinder 15 with the amount of oil contained in the spaces "b", "g" and "e" and in the pipings 51, 52 and 53.

Then the stiffness factor $k_1$ of the group of elastic members of the device is set by the volumetric oil regulator 21, said group incorporating the components of the hydraulic cylinder 15 and of the volumetric oil regulator 21, as well as the hydraulic piping 54 which constitute an oil-filled enclosed space. The stiffness factor $k_1$ is determined with regard to the stiffness factor k of the roll mill stand from the following equation $$k_1 = k \cdot (k_2 - 1); \tag{16}$$

where $k_2$ is the factor of proportionality between the variation of the rolling force P and the adjusting force R of the hydraulic cylinder 15 as results from the thickness control equation $$\delta h = \frac{\Delta P}{k} - \frac{\Delta R - \Delta P}{k_1} = 0. \quad (17)$$

As a result of the effect of the initial pressure in the units of the device, the piston 33 (FIG. 3) of the hydraulic dynamometer 14 is forced against the cover 34 by virtue of the difference between the force produced by the pressure $q_1$ in the chamber "a" of the hydraulic dynamometer 14 and the force $N_o$ of the hydraulic cylinders 12 and 13 pressing the chock 9 (FIG. 2) against the hydraulic dynamometer 14. Also, the piston 36 of the double-space hydraulic cylinder 15 is forced against the bottom of the barrel 16 by virtue of the force $Q_o+G-R_1$ where $$Q_o = q_o \cdot F_c; \quad (18)$$

$$R_1 = q_1 \cdot F_b; \quad (19)$$

G is the total weight of the rolls complete with the chocks, account being taken of the thrust developed by the hydraulic cylinders 12 and 13.

Thus, the bottom rolls 4 and 8, which rest upon the hydraulic cylinder 15 by means of the chock 10, and the top rolls 3 and 7, which rest on the hydraulic dynamometer 14 by means of the chock 9, are fixed in the initial positions.

Then the initial gap $h_o$ is set between the work rolls 3 and 4 using the screwdown arrangement 11.

The size of said gap is to be taken from the following equation:

$$h_o = h - \frac{2q_o \cdot F_a - G}{k}; \quad (20)$$

where h is the preset outgoing thickness of the finished strip stock.

The device operates as follows.

When entering the strip stock into the work rolls 3 and 4 (FIG. 2), the rolling force P arises in the roll mill stand 1.

The components of the roll mill stand 1, including the hydraulic dynamometer 14 and the hydraulic cylinder 15, acted upon by said force undergo elastic strain, thus changing the gap between the rolls 3 and 4.

The increment value $\delta h_o$ of the gap between the rolls 3 and 4 due to the deformation of the roll mill stand 1 depends upon the amount of the initial pressure $q_o$ of oil contained in the space formed by the chambers "c" and "i" and is equal to the deformation of the roll mill stand 1 caused by the rolling force P which corresponds to the pressure $q_o$ of oil effective in the hydraulic dynamometer 14

$$\delta h_o = \frac{q_o \cdot 2F_a - G}{k} \quad (21)$$

Further increments $\delta h_1$ of deformation of the roll mill stand, which may be due to the variation $\Delta P$ of the pressure P exerted by the metal upon the roll with respect to the value $2q_o \cdot Fa - G$, are compensated for by a corresponding movement of the chocks 10 of the roll 8.

Thus, the thickness of the strip stock leaving the roll mill stand 1 is equal to $$h_1 = h_o + \frac{2q_o \cdot F_a - G}{k} \quad (22)$$

As soon as the oil pressure in the chamber "a" of the hydraulic dynamometer 14 and in the control chamber "d"of the valve 17 increases, the check valve 22 is closed to form an enclosed space made up of the chamber "a" of the hydraulic dynamometer 14 and the control chamber "d" of the valve 17, wherein the pressure q of oil is effectively proportionate to the rolling force P, i.e.

$$q = \frac{P}{2F_a} + \frac{N_o}{2F_a} \quad (23)$$

As a result of the action of said pressure in the control chamber "d" of the valve 17, the state of balance of the sliding spool 41 (FIG. 5) is upset, and the spool 41 is displaced towards the cover 42, thus reducing the gap "y" between the sliding spool 41 and the cover 42, with the result that the resistance to the oil flow passing from the throttle chamber "e" through the gap "y" to the drainback chamber "f" is increased, and, consequently, the pressure developed by the pumping unit 18 (FIG. 2) increases accordingly.

Once the pressure developed by the pumping unit 18 exceeds the value $q_1$, the force $R = q_2 \cdot F_b$ increases in the piston-end space "b" of the double-space hydraulic cylinder 15, which actuates the piston 36 and the barrel 16. Part of said force ($q \cdot 2F_a$) provides for the rolling force P and balances the weight G of the rolls and chocks, whereas the difference between the forces (R−P−G) is applied to the group of elastic members of the device.

As soon as the force R is in excess of the rolling force P and the force $Q_o$ created by the oil pressure $q_o$ effective in the piston-rod space "c" of the hydraulic cylinder 15, the barrel 16 begins to move with respect to the piston 36. This, in turn, reduces the volume of the piston-rod space "c", whereby the oil contained therein is compressed and, hence, the oil pressure in the piston-rod space "c" of the hydraulic cylinder 15 and in the chamber "i" of the volumetric oil regulator 21 is increased. As a result, the check valve 23 is closed to form an enclosed space made up of the piston-rod space "c" of the hydraulic cylinder 15 and the chamber "i" of the volumetric oil regulator 21.

Thus, the barrel 16 of the hydraulic cylinder 15 moves along with the chock 10 of the bottom backup roll 8 for a distance corresponding to the value of the oil compression effective in said enclosed space. This movement is due to the change of the oil pressure in the piston-end space "b" and, hence, due to a change in the pressure developed by the pumping unit 18.

A pressure increase of the pumping unit 18 when controlling the thickness of the strip stock being rolled is caused for two reasons:

firstly, inadequacy of the pressure developed by the pumping unit 18 and the pressure in the enclosed space made up by the chambers "a" and "b";

secondly, the resistance offered to the rolling force P and to the force Q of oil compression in the enclosed space made up by the chambers "c" and "i", which prevents movement of the piston under the effect of the force R proportionate to the pressure of the pumping unit 18.

That is why the barrel 16 moves with respect to the piston 36 until the sliding spool 41 is balanced by the oil pressure effective in the control chamber "d" and the throttle chamber "e" of the valve 17, and until the barrel 16 of the hydraulic cylinder 15 is balanced from one side by the force R and from other side by the rolling force P and by the force Q of oil compression effective in the enclosed space made up by the chambers "c" and "i". In this case the distance of the movement of the barrel 16 from its initial position (before the rolling process), resulting from its balanced state at the stiffness factor $k_1$ of the enclosed space made up by the chambers "c" and "i", is equal to $$\delta h_2 = \frac{R - P - Q_o - G}{k_1} \tag{24}$$

Substituting the value $Q_o$ in to equation (24), whose magnitude is found from the balanced state of the barrel 16 of the hydraulic cylinder 15 at the moment of application of the force of rolling, at which $P_o = 2q_o \cdot F_a - G$ and the force $R = 2q_o \cdot F_b$ $$Q_o = R_o = P_o - G \tag{25}$$

one can find the amount of movement of the barrel 16 of the hydraulic cylinder 15 as the function of the increment values $\Delta R$ and $\Delta P$ $$\delta h_2 = \frac{\Delta R - \Delta P}{k_1} \tag{26}$$

In this case the aggregate change of the roll gap and hence the change of the strip stock thickness with due account of the traverse $\delta h_2$ can be described by equation (17)

$$\delta h = \frac{\Delta P}{k} - \frac{\Delta R - \Delta P}{k_1} = 0 \tag{17}$$

The thickness $h_1$ of the strip stock leaving the roll mill stand 1 is expressed by the following equation $$h_1 = h_o + \frac{2q_o \cdot F_a - G}{k} + \frac{\Delta P}{k} - \frac{\Delta R - \Delta P}{k_1} \tag{27}$$

When realizing relation (16) between the factors k and $k_1$, the right-hand member of equation (17) equals zero. Hence any change of the gap $\delta h$ between the rolls 3 and 4 and of the thickness $h_1$ of the strip stock due to deformation of the roll mill stand 1 is eliminated.

As a result of operation of the device according to the thickness control equation (17), absolutely stiff mechanical characteristics of the system "stand-device" is attained at $\delta h = 0$, whereby the effect of the elastic deformation if the roll mill stand upon the strip thickness in response to a change in the force of rolling within the interval $$P \leqq 2q_o \cdot F_a - G \tag{28}$$

is completely eliminated.

When the sliding spool 41 of the valve 17 is in the balanced state, oil delivered by the pumping unit 18 flows from the throttle chamber "e" through the gap "y" (FIG. 5) to the drainback chamber "f" and, from there, on through the valve 27 to the tank 26 (FIG. 2).

Upon discharging the strip stock from the mill stand rolls, the oil pressure effective in the enclosed space made up by the chambers "a" and "d" drops to the initial value $q_1$. The same pressure is developed by the pumping unit 18.

As a result, the piston 36 of the hydraulic dynamometer 14 and the barrel 16 of the double-space hydraulic cylinder return to the initial positions, and the pressure in the enclosed space made up by the chambers "c" and "i" becomes equal to zero.

Thus, the device is ready for the next operating cycle.

In order to add to the stiffness of the elastic members of the device, a spring 61 (FIG. 4) is provided in the enclosed piston-rod space "c" of the hydraulic cylinder 15, said spring resting with its ends upon the piston 36 and the cover 37 to establish, along with the pressure fluid and the components constituting the enclosed piston-rod space "c", the elastic members of the device.

Provision of said spring 61 in the piston-rod space "c" of the hydraulic cylinder 15 is instrumental for proper matching of the required value of the stiffness factor $k_1$ of the elastic members of the device. As to all the rest of the operating particulars these remain the same as described above.

Figure 8:
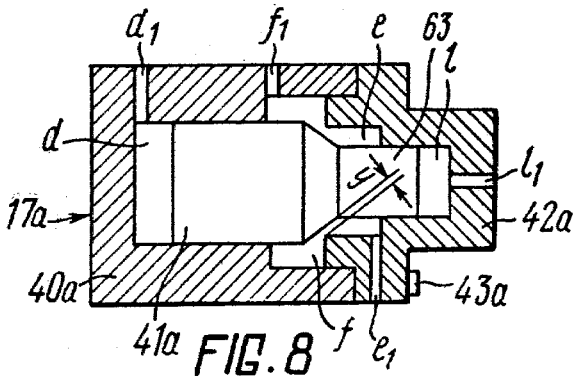
FIG. 8 is an enlarged sectional view of the valve for power fluid pressure control in the hydraulic cylinder interior of the device shown in FIG. 7, taken in an axial plane thereof.
Figure 7:
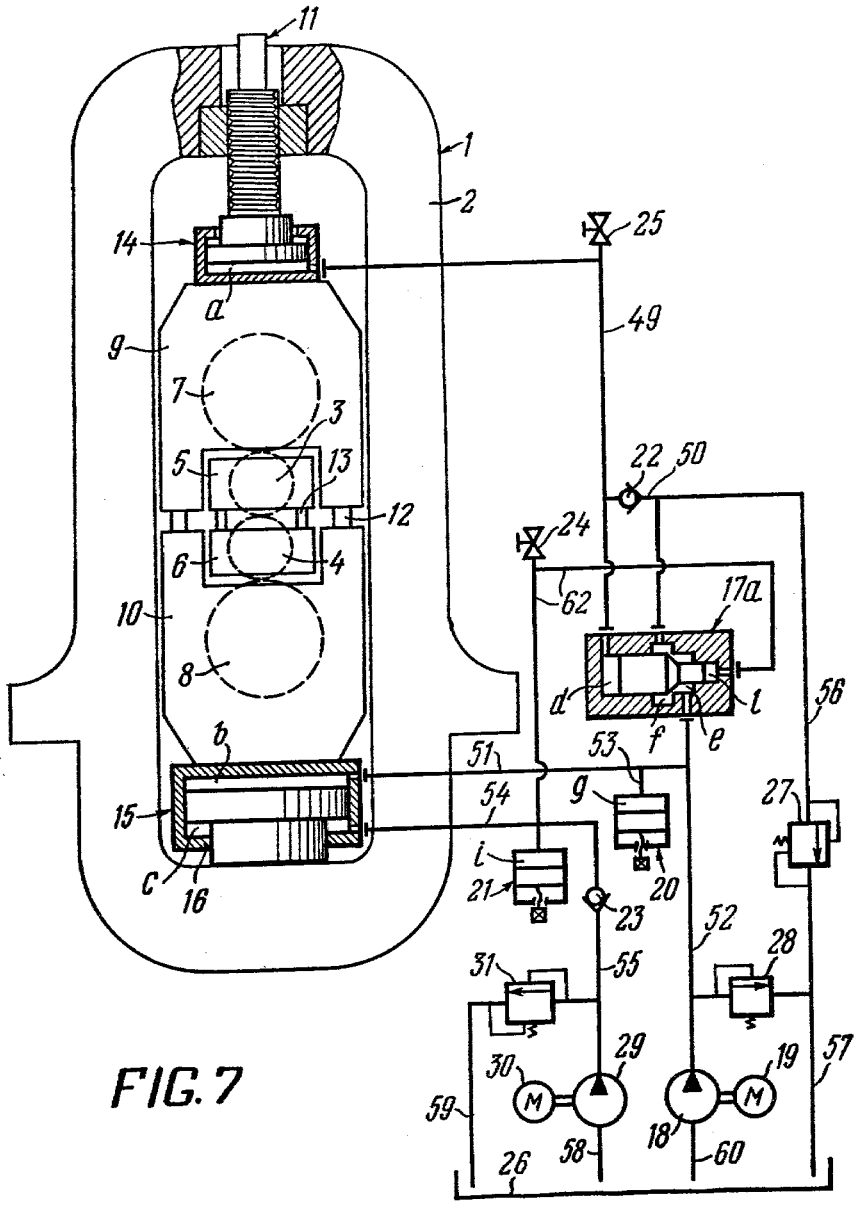
FIG. 7 is an elevational view of a roll mill stand as seen from the operator's side, partially in section, showing the device for controlling the thickness of the strip stock being rolled between rolls, wherein the valve sliding spool is stepped.

A second embodiment of the device for controlling the thickness of the strip stock being rolled, as illustrated in FIGS. 7 and 8, differs from the device shown in FIGS. 2 to 6 in that the valve 17*a* (FIG. 7) is provided with an additional control chamber "1" which communicates through hydraulic pipings 62 and 54 with the enclosed space formed by the chambers "c" and "i".

The remaining units of the device, such as the hydraulic dynamometer 14, the double-space hydraulic cylinder 15, the pumping units 18 and 29 with the motors 19 and 30, the volumetric oil regulators 20 and 21, the valves 27 and 31, the pressure relief valve 28, the check valves 22 and 23, the stop valves 24 and 25, the oil tank 26, and the hydraulic pipings 49–60 perform the same functions as in the embodiment disclosed hereinbefore and have the same reference numerals.

Figure 5:
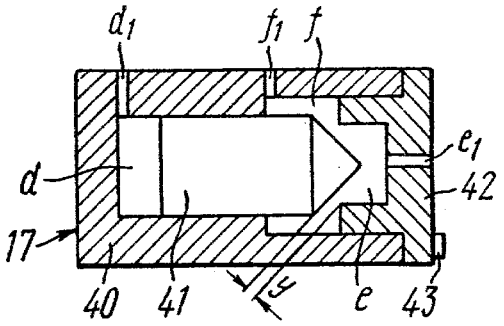
FIG. 5 is an enlarged sectional view of the valve for power fluid pressure control in the hydraulic cylinder interior, taken in an axial plane thereof.

As to the modified valve 17*a*, its chambers and ports which perform the similar functions as in the device of FIGS. 2 and 5 of the embodiment considered hereinbefore, have the same reference numerals, but followed by letter indexes.

The valve 17*a* (FIG. 8) comprises a casing 40*a*, a stepped sliding spool 41*a* having a step 63, and a cover 42*a* held to the casing 40*a* by screws 43*a*.

The sliding spool 41*a* along with the casing 40*a* defines the main control chamber "d" communicating with the port $d_1$; the sliding spool 41*a* with its step 63 and the cover 42*a* define the control chamber "1" communinating with the port $1_1$ and the throttle chamber "*e*" communicating with the port "$e_1$"; the sliding spool 41*a*, the casing 40*a* and the cover 42*a* define the drainback chamber f communicating with the port $f_1$; and, the sliding spool 41*a* and the cover 42*a* define the throttling gap "y".

All the aforesaid chambers are hermetically sealed by virture of seals (not shown).

Hydraulic communication between the chambers "d", "e" and "f" with the other units of the device is effected in the same way as in the embodiment described hereinabove. The control chamber "1" of the valve 17*a* communicates, through the hydraulic pipings 62 and 54 (FIG. 7) with the enclosed space made up of the chambers "c" and "i". Such communication enables one to control the pressure and flow-rate of the oil in the piston-end space "b" of the double-space hydraulic cylinder 15 in proportion to the stress applied to the group of elastic members of the device, constituted by the piston-rod space "c" of the double-space hydraulic cylinder 15, the chamber "i" of the volumetric oil regulator 21 and the control chamber "1" of the valve 17*a*, whereby the speed of response of the device, according to said embodiment, is higher as compared to the device according to the embodiment disclosed hereinbefore.

The amount ΔV of oil fed to the piston-end space "b" of the hydraulic cylinder 15 according to the first embodiment of the present invention, is equal to $$\Delta V = k_4 \cdot \Delta P; \tag{29}$$

where $k_4$ is the factor of proportionality between the change in the force of rolling and the amount of oil fed to the piston-end space "b" of the hydraulic cylinder 15.

Consider the relationship between the parameters ΔV and ΔP for the device of the second embodiment of the present invention.

Taking into account the sluggishness of the device in response to a change in the rolling force by the value ΔP, the barrel 16 of the hydraulic cylinder 15 is moved due to the deformation $\delta h_3$ of the oil contained in the piston-end space "b", by a value equal to $$\delta h_3 = \frac{\Delta P}{k_5 + k_1}; \tag{30}$$

where $k_5$ is the stiffness factor of the oil contained in the piston-end space "b" of the hydraulic cylinder 15 and in the hydraulic pipings 51 through 53, as well as in the chambers "g" and "e".

In this case the variation of the stress value of the group of elastic members of the device obey the following equation $$\Delta Q = \delta h_3 \cdot k_1 \tag{31}$$

Substituting expression (30) in to equation (31) one can find the relationship between the value ΔQ of variation of the stress applied to the group of elastic members of the device and the value ΔP of the change in the rolling force $$\Delta Q = \frac{\Delta P}{1 + \frac{k_5}{k_1}}. \tag{32}$$

Taking account of expression (32) the resultant signal controlling the oil flow-rate is equal to $$\Delta P + \Delta Q = \Delta P \cdot \left(1 + \frac{1}{1 + \frac{k_5}{k_1}}\right). \tag{33}$$

The amount of oil fed to the hydraulic cylinder 15 in response to a change of the rolling force P by the value ΔP, equals $$\Delta V_1 = k_4 \cdot \Delta P\left(1 + \frac{1}{1 + \frac{k_5}{k_1}}\right). \tag{34}$$

When comparing expressions (29) and (34), one can easily determine that the amount $\Delta V_1$ of oil fed to the hydraulic cylinder space in response to a change in the rolling force P by the value ΔP, according to the second embodiment of the invention, is greater than that according to the first embodiment thereof by the value $$\Delta V_2 = k_4 \cdot \Delta P \cdot \frac{1}{1 + \frac{k_5}{k_1}} \tag{35}$$

and hence the control time is shorter.

It is easy to evidence that the accuracy of control in the second embodiment is higher than in the first one.

If, according to the device of the first embodiment of the invention, the force $F_1$ of friction arising between the movable components of the hydraulic cylinder 15 affects the amount of movement thereof, the elastic members of the device absorbs a force equal to $$\Delta Q = \Delta R - \Delta P \pm F_1; \tag{36}$$

while the amount of said movement itself equals $$\delta h_2 = \frac{\Delta Q}{k_1} = \frac{\Delta R - \Delta P \pm F_1}{k_1}, \tag{37}$$

and the inaccuracy or deviation of movement of the barrel 16 of the hydraulic cylinder 15, according to the first embodiment, equals $\pm(F_1/k_1$.

According to the second embodiment of the invention, the amount of oil fed to the hydraulic cylinder 15 is proportionate to the value ΔP by which the rolling force P is changed and to the value ΔQ by which the force Q of deformation is varied, obeying the equation $$\frac{\Delta P}{k} - \frac{\Delta Q}{k_1} = \delta h \tag{38}$$

Once the equation $$\frac{\Delta P}{k} = \frac{\Delta Q}{k_1}$$

has been satisfied, oil ceases to be fed to the hydraulic cylinder 15.

In this case the amount of movement of the barrel 16 of the hydraulic cylinder 15 is equal to $$\delta h_2 = \frac{\Delta Q}{k_1} = \frac{\Delta P}{k} \tag{39}$$

and is independent of the forces of friction in the movable components of the hydraulic cylinder 15.

The device is adjusted before the strip stock rolling process and put into operation upon entering the strip stock into the roll mill stand 1 in a way similar to that described with reference to the first embodiment of the invention.

Now, consider the operation of the device during the rolling process in the case where the thickness of the strip stock at the entrance to the rolls of the mill stand 1 increases.

When a larger thickness of the strip stock is to be rolled, the rolling force P increases by the value ΔP and hence the pressure q of the oil in the enclosed space, made up by the chambers "a" and "d", is increased by the value Δq, while the pressure in the enclosed, space made up by the chambers "c", "i" and "1", decreases. As a result, the balanced state of the sliding spool 41*a* (FIG. 8) is upset and the spool 41*a* moves toward the chamber "e", thus reducing the gap "y" between itself and the cover 42*a*, with the resultant increase in resistance to the oil flow from the pumping unit 18 (FIG. 7) and, consequently, a higher pressure $q_2$ of said pumping unit by the value $\Delta q_2$. As a result of the pressure increment by the value $\Delta q_2$, an additional force is developed in the piston-end space "b" of the hydraulic cylinder 15 equal to $\Delta R = \Delta q_2 \cdot F_b$, part of said pressure offering resistance to the increment ΔP of the rolling force P, whereas the difference between the force R created by the hydraulic cylinder 15 under the effect of oil pressure effective in the piston-end space "b" and by the rolling force P, compresses the oil contained in an enclosed space made up by the chambers "c", "i" and "1". Thus, the barrel 16 of the hydraulic cylinder 15 moves along with the chock 10 of the bottom backup roll 8 for a distance corresponding to the magnitude of compression of the oil in said enclosed space.

Movement of the barrel 16 with respect to the piston 36 (FIG. 4) of the hydraulic cylinder 15 occurs due to a change in the oil pressure effective in the piston-end space "b" and hence due to a change in the pressure produced by the pumping unit 18.

The pressure of the pumping unit 18 changes until the sliding spool 41*a* (FIG. 8) of the valve 17*a* becomes balanced by the oil pressure effective in the enclosed spaces made up by the chambers "a", and "d" and "c", "i" and "1", and due to the pressure of the pumping unit 18 (FIG. 7), and until the barrel 16 of the double-space cylinder 15 becomes balanced by the force R provided by the hydraulic cylinder 15 under the effect of the pressure in the piston-end space "b" established by the pumping unit 18, by the force Q of oil compression in the enclosed space made up by the chambers "c", "i" and "1", and by the rolling force P.

The amount of movement of the roll prior to balancing the sliding spool 41*a* (FIG. 8) of the valve 17*a* and the barrel 16 (FIG. 7) of the hydraulic cylinder 15 is equal to $$\delta h_2 = \frac{\Delta Q}{k_1} \tag{37}$$

where ΔQ is the value of the variation of the compression force of the enclosed space made up by the chambers "c", "i", "1".

In this case a total change of the gap between the rolls 3 and 4 and, hence, of the strip thickness with account of the movement of the chocks 10 of the bottom roll 8 for a length $\delta h_2$ is equal to $$\delta h = \frac{\Delta P}{k} - \frac{\Delta Q}{k_1} \tag{38}$$

while the thickness of the strip leaving the roll mill stand 1 is expressed by the following equation $$h_1 = h_o + \frac{2q_o \cdot F_a - G}{k} + \frac{\Delta P}{k} - \frac{\Delta Q}{k_1}. \tag{27}$$

When realizing relation (16) the right-hand member of equation (38) equals zero. Hence, any variation of the gap between the rolls 3 and 4 and of the outgoing strip thickness $h_1$ due to deformation of the roll mill stand 1 is eliminated.

When the sliding spool 41*a* (FIG. 8) of the valve 17*a* and the barrel 16 (FIG. 7) of the hydraulic cylinder 15 are in balanced states, as well as upon discharging the strip stock from the rolls 3 and 4 of the roll mill stand 1, the device operates in a similar manner to the one of the first embodiment of the invention.

It is possible to fashion the hydraulic dynamometer 14 and the hydraulic cylinder 15 as a hydraulic panel 64 (FIG. 9), a feature that enables the afore-described devices to be more compact.

Figure 9:
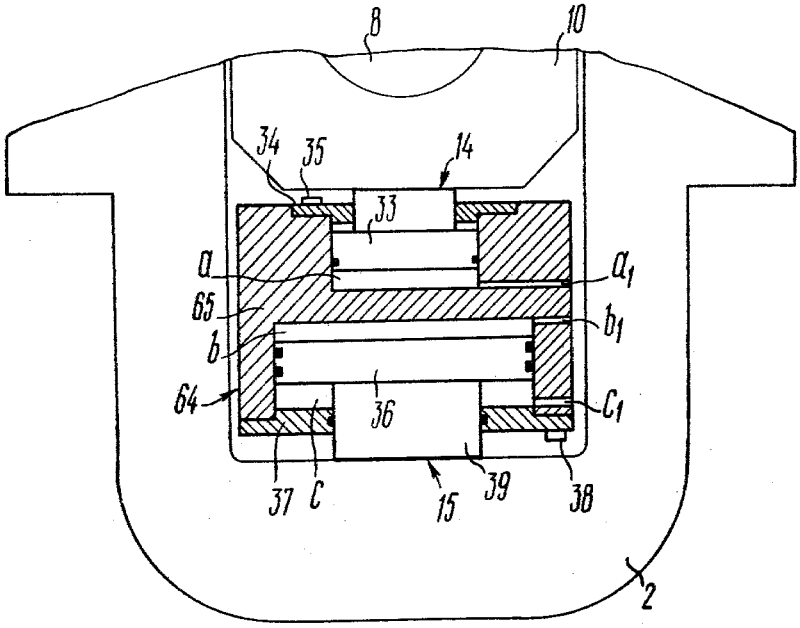
FIG. 9 is the sectional view of a hydraulic dynamometer and hydraulic cylinder made as a hydraulic panel, taken in an axial plane thereof.

FIG. 9 illustrates the bottom portion of the recess of the roll mill stand 2, and shows the hydraulic panel 64 situated between the chock 10 of the bottom backup roll 8 and the roll mill stand 2.

Figure 3:
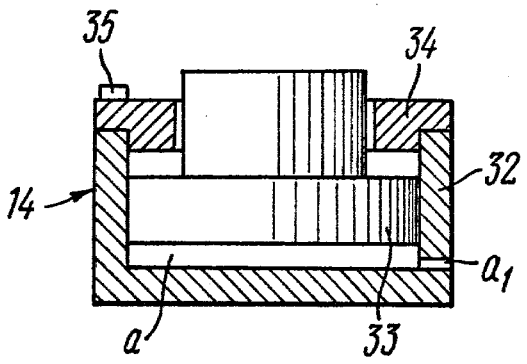
FIG. 3 is an enlarged sectional view of the hydraulic dynamometer, taken in an axial plane thereof.
Figure 4:
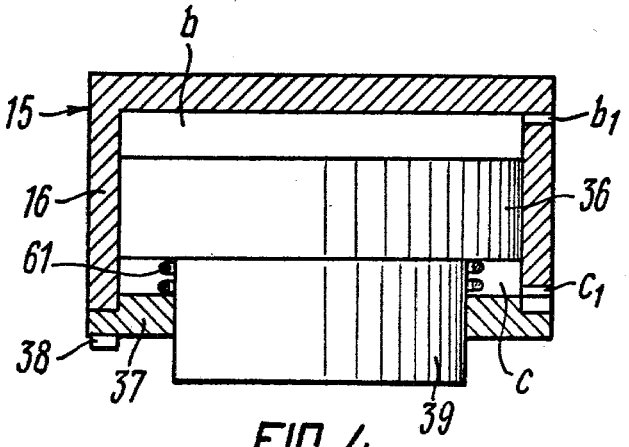
FIG. 4 is an enlarged sectional view of the double-space hydraulic cylinder, taken in an axial plane thereof.

The components of the hydraulic dynamometer 14 (FIG. 3), i.e., the piston 33, the cover 34 and the screws 35, and those of the hydraulic cylinder 15 (FIG. 4), that is, the piston 36 with the rod 39, the cover 37 and the screws 38, which make up part of the constructional arrangement of the hydraulic panel 64 (FIG. 9), as well as their respective chambers "a", "b" and "c", perform similar functions and are indicated at the same reference numerals as in FIGS. 3 and 4.

The hydraulic panel 64 has a casing 65 inclosing the piston 33, both of them forming the hydraulic dynamometer 14 having the chamber "a" communicating with the port "$a_1$" and filled with oil; the cover 34 is held to the casing 65 by the screws 35. The piston 36 and the cover 37 are held to the casing 65 by the screws 38. The piston 36 and its rod 39 establish, along with the casing 65 and the cover 37, the double-space hydraulic cylinder 15 having the piston-end space "b" and the piston-rod space "c" which communicate with the ports "$b_1$" and "$c_1$", respectively.

The hydraulic panel 64 is adapted to interact, by means of the piston 33 of the hydraulic dynamometer, with the chock 10 of the bottom backup roll 8, and, by means of the rod 39 of the piston 36 of the double-space hydraulic cylinder 15, with the mill separator of the roll housing 2.

To reduce the overall height of the hydraulic panel 64 the latter may have a plurality of hydraulic dynamometers 14 and of double-space hydraulic cylinders 15.

Figure 10:
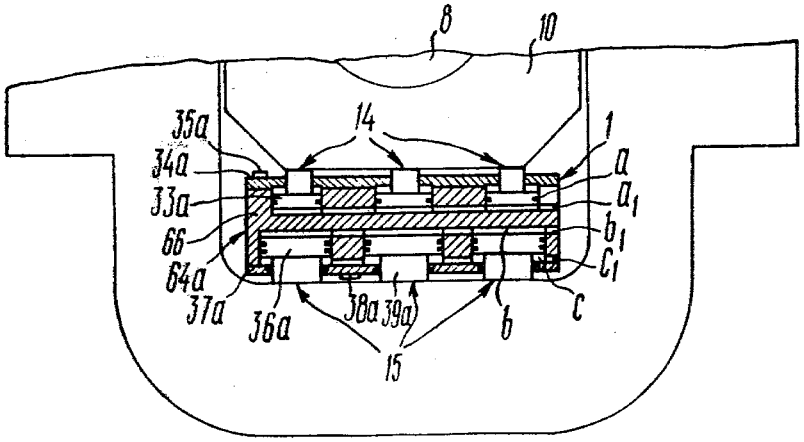
FIG. 10 is a sectional view of an embodiment of the hydraulic panel having three hydraulic dynamometers and three hydraulic cylinders, taken in an axial plane thereof.

FIG. 10 illustrates an embodiment of the hydraulic panel provided with three hydraulic dynamometers 14 and three hydraulic cylinders 15. It is quite possible that the number of hydraulic dynamometers 14 and hydraulic cylinders 15 in the device may be more or less than three.

The hydraulic panel components illustrated in FIG. 10 are indicated at the same reference numerals as in FIG. 9 but followed by letter indexes.

The hydraulic panel 64*a* (FIG. 10) incloses three pistons 33*a* which form, along with the casing 66, the hydraulic dynamometers 14 having the chambers "a"

communicating with one another and with the port "$a_1$" provided in the casing 66, the cover 34*a* being held to the casing 66 by the screws 35*a*. The panel 64*a* also inclosed three pistons 36*a*, the cover 37*a* being held to the casing 66 by the screws 38*a*. The pistons 36*a* and the rods 39*a* thereof form, along with the casing 66 and the cover 37*a*, the double-space hydraulic cylinders 15 having the piston-end spaces "b" and the piston-rod spaces "c". The like spaces of the double-space hydraulic cylinders 15 communicate with each other and with the respective ports "$b_1$" and "$c_1$" made in the casing 66.

The hydraulic panel 64*a* provided according to said embodiment of the invention is adapted to interact, by means of all the pistons 33*a* of the hydraulic dynamometers 14, with the chock 10 of the bottom backup roll 8 and, by means of all the rods 39*a* of the pistons 36*a* of the double-space hydraulic cylinders 15, with the mill separator of the roll stand 2.

In both of the embodiments of the hydraulic panel, the axes of the hydraulic dynamometers 14 coincide with the axes of the hydraulic cylinders 15.

Figure 11:
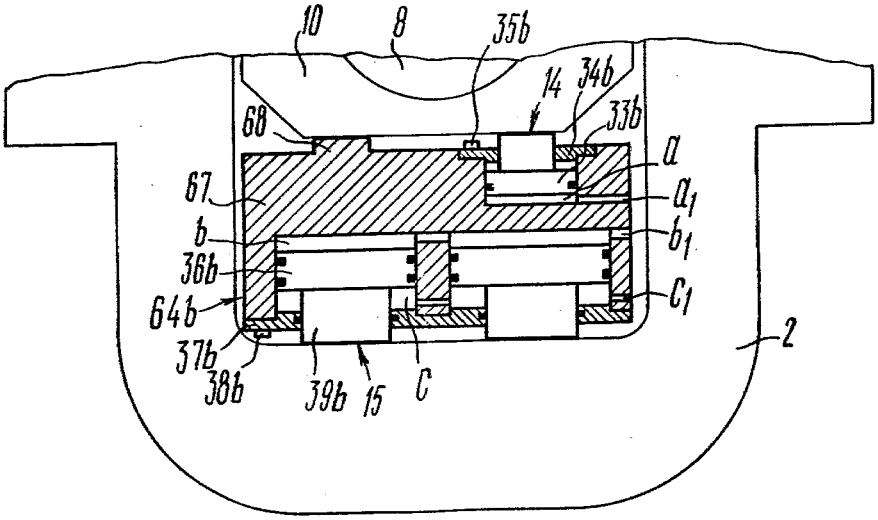
FIG. 11 is a sectional view of another embodiment of the hydraulic panel having one hydraulic dynamometer and two hydraulic cylinders, wherein the axis of the hydraulic dynamometer coincides with that of one of the hydraulic cylinders, taken in a plane of coinciding axes of the hydraulic dynamometer and one of the hydraulic cylinders and in an axial plane of the other cylinder.

FIG. 11 shows an embodiment of the hydraulic panel having one hydraulic dynamometer 14 and two hydraulic cylinders 15, the axis of the hydraulic dynamometer 14 coinciding with the axis of one of the hydraulic cylinders 15. Such a constructional arrangement of the hydraulic panel is simpler as compared to the above-described ones.

The hydraulic panel 64*b* has a casing 67 with a step 68. The piston 33*b* forms, along with the casing 67, the hydraulic dynamometer 14 having the chamber "a" communicating with the port "$a_1$". The cover 34*b* is held to the casing 67 by the screws 35*b*. The cover 37*b* is held to the casing 67 by the screws 38*b*. The pistons 36*b* and their rods 39*b* form, along with the casing 67 and the cover 37*b*, the hydraulic cylinders 15 having the piston-end space "b" and the piston-rod space "c". The like spaces of the hydraulic cylinders 15 communicate with each other and with the respective ports "$b_1$" and "$c_1$".

The hydraulic panel 64*b* is adapted to interact, by means of the piston 33*b* of the hydraulic dynamometer 14 and the step 68 of the casing 67, with the chock 10 of the backup roll 8 and, by means of the rods 39*b* of the pistons 36*b* of the hydraulic cylinders 15, with the bottom mill separator of the roll housing 2.

During the rolling process the hydraulic dynamometer 14 is to absorb the force proportionate to the rolling force P, in a way similar to the embodiments described above. Such an embodiment of the hydraulic panel makes it possible to simplify the construction of the device.

The hydraulic panel may have one hydraulic dynamometer 14 and a plurality of hydraulic cylinders 15 spaced apart round the hydraulic dynamometer 14. Such an embodiment of the hydraulic panel enables it to be located between the pressure screw 11 (FIG. 2) and the chock 9 of the top backup roll 7.

Figure 12:
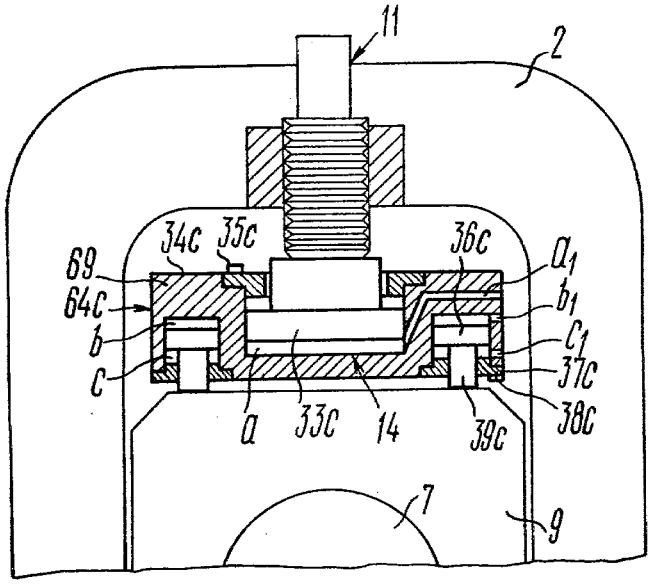
FIG. 12 is a sectional view of another embodiment of the hydraulic panel having a centrally situated hydraulic dynamometer and two peripherally disposed hydraulic cylinders, taken in a plane of the axes of the hydraulic dynamometer and hydraulic cylinders.

FIG. 12 shows an embodiment of the hydraulic panel 64*c* having one hydraulic dynamometer 14 and two hydraulic cylinders 15.

Said hydraulic panel 64*c* has a casing 69, which along with the piston 33*c* forms the hydraulic dynamometer 14 having the chamber "a" communicating with the port "$a_1$". The cover 34*c* is held to the casing 69 by the screws 35*c* and the covers 37*c* is held to the casing 69 by the screws 38*c*. The piston 36*c* and its rod 39*c* form, along with the casing 69 and the cover 37*c*, the double-space hydraulic cylinders 15 having the piston-end space "b" and the piston-rod space "c". The like spaces of the hydraulic cylinders 15 communicate with each other and with the respective ports "$b_1$" and "$c_1$".

The hydraulic panel 64*c* is to interact with the pressure screw 11 by means of the piston 33*c* and with the chock 9 of the top backup roll 7 by means of the rods 39*c* of the pistons 36*c*.

The chamber "a" and the spaces "b" and "c" of the hydraulic panels as illustrated in FIGS. 9 through 12, are hermetically sealed by virtue of seals (not shown), while hydraulic communication of said chamber and said spaces with the units of the device is effected in the same way as in the above-described embodiments of the device, viz., through the respective ports "$a_1$", "$b_1$" and "$c_1$".

Figure 13:
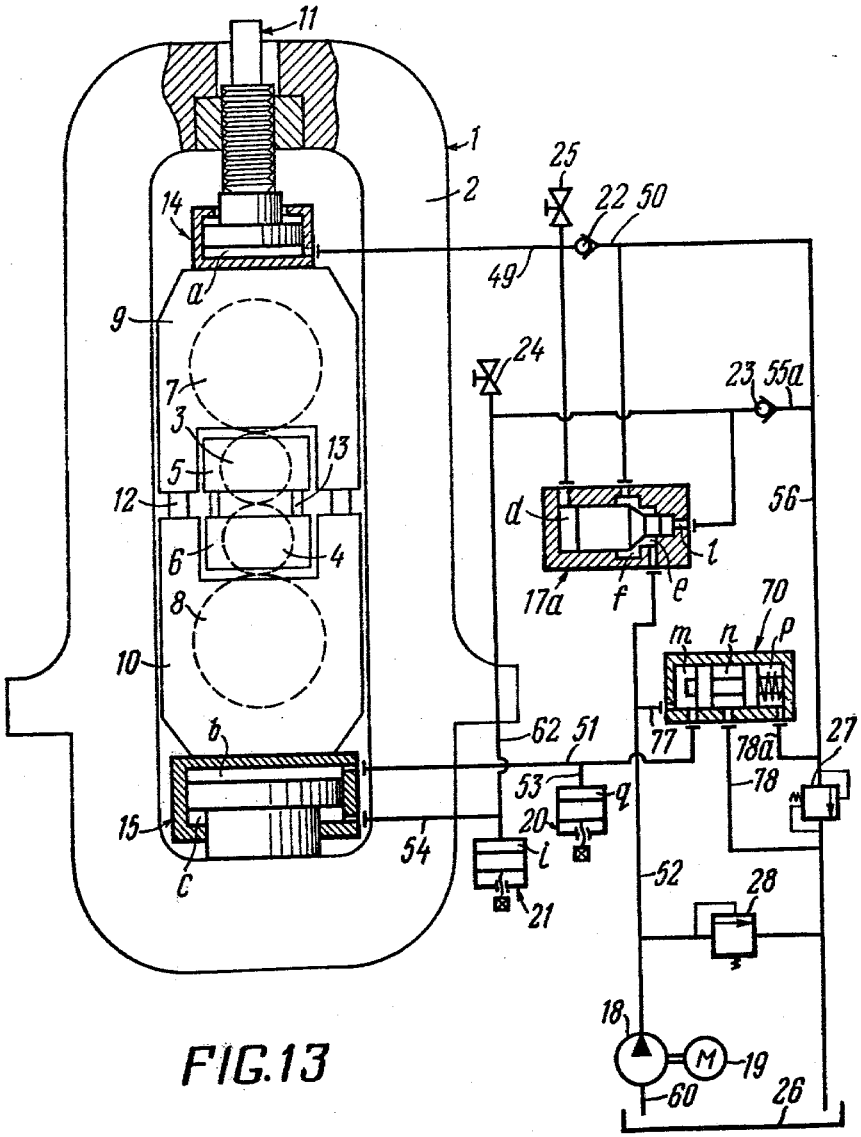
FIG. 13 is an elevational view of a roll mill stand as seen at from the operator's side, partially in section, showing the device for controlling the thickness of the strip stock being rolled between rolls, wherein a reversing spool valve is provided.
Figure 14:
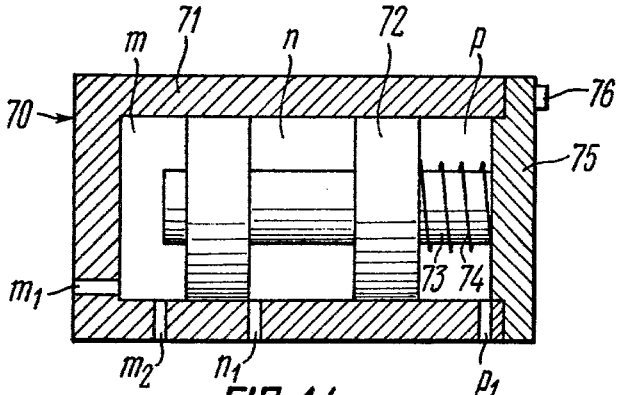
FIG. 14 is an enlarged section view of the reversing spool valve of the device shown in FIG. 13.

An embodiment of the device for controlling the thickness of the strip stock being rolled between the rolls of a mill stand as illustrated in FIGS. 13 and 14, differs from the devices shown in FIGS. 2–6 and 7–8 in that provision is made therein for a reversing spool valve 70 (FIG. 13) which is adapted, upon putting the device in operation, to place in communication the piston-end space "b" of the hydraulic cylinder 15 and the pumping unit 18, and upon discharging the strip stock from the rolls, to place in communication said space and the oil tank 26.

Provision of the reversing spool valve 70 in the hydraulic circuit of the device enables simplification of the device. In particular, such units as the pumping unit 29 with the motor 30, the valve 31 and the hydraulic pipings 58 and 59 can be omitted. The rest of the units of the device, i.e., the hydraulic dynamometer 14, the double-space hydraulic cylinder 15, the pumping unit 18 with the motor 19, the volumetric oil regulators 20 and 21, the valve 27, the pressure relief valve 28, the check valves 22 and 23, the stop valves 24 and 25 and the oil tank 26, as well as the hydraulic pipings 49-57 and 60-62 perform the same functions as in the first and second embodiments of the device and are indicated by the same reference numerals.

The reversible spool valve 70 (FIG. 14) has a casing 71 accomodating a spool 72 loaded at the end of a tail-piece 73 by a spring 74 which rests upon a cover 75 held to the casing 71 by screws 76. The spool 72 along with the casing 71 defines a chamber "m" communicating with ports "$m_1$" and "$m_2$" and an end chamber "n" communicating with a port "$n_1$". And, along with the casing 71 and the cover 75 the spool 72 defines a chamber "p" communicating with a port "$p_1$".

Hydraulic communication of the reversible spool valve 70 (FIG. 13) is effected as follows. The chamber "m" communicates with the pumping unit 18 via the port "$m_1$" (FIG. 14) and a hydraulic piping 77 (FIG. 13) connected to the hydraulic piping 52. Via the port "$m_2$" and the hydraulic piping 51 (FIG. 13) said chamber "m" communicates with the piston-end space "b" of the hydraulic cylinder 15. The chamber "p" communicates with the hydraulic piping 56 through the port "$p_1$" (FIG. 14) and a hydraulic piping 78 (FIG. 13). The end chamber "n" of the reversing spool valve 70 communicates with the tank 26 (FIG. 13) through the port "$n_1$" (FIG. 14) and through the hydraulic pipings 78*a* and 57.

In the herein-described embodiment of the invention the way by which the space established by the piston-rod space "c" of the double-space hydraulic cylinder 15, the chamber "i" of the volumetric oil regulator 21 and the control chamber "1" of the pressure valve 17*a* communicates with the source of power fluid (oil), is modified, i.e., said space communicates with the hydraulic piping 56 through the hydraulic piping 55*a* and the check valve 23, the pressure in said hydraulic piping 56 being created and kept always constant with the use of the valve 27 when oil flows therethrough.

The device according to the embodiment described above is adjusted before the rolling process, put in operation and operated in the course of thickness control of the strip stock being rolled in a way similar to that described in the two embodiments discussed hereinbefore.

Figure 16:
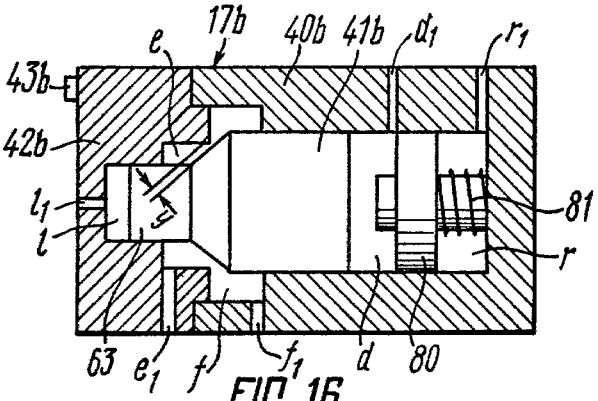
FIG. 16 is an enlarged view of the valve for power fluid pressure control in the hydraulic cylinder interior as seen in the device shown in FIG. 15.
Figure 17:
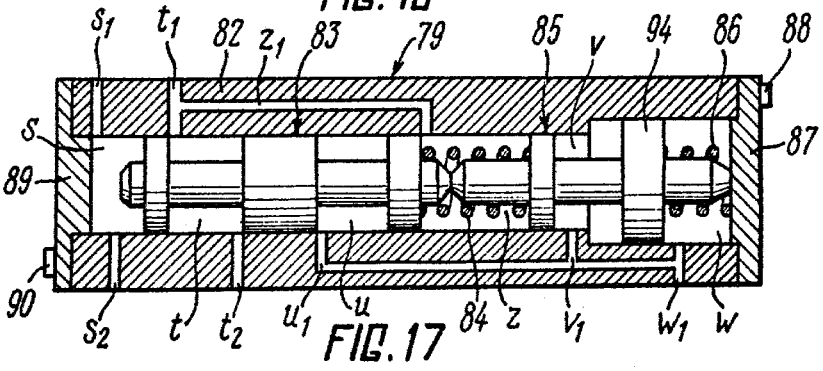
FIG. 17 is an enlarged view of the reversing spool valve of the device shown in FIG. 15.
Figure 15:
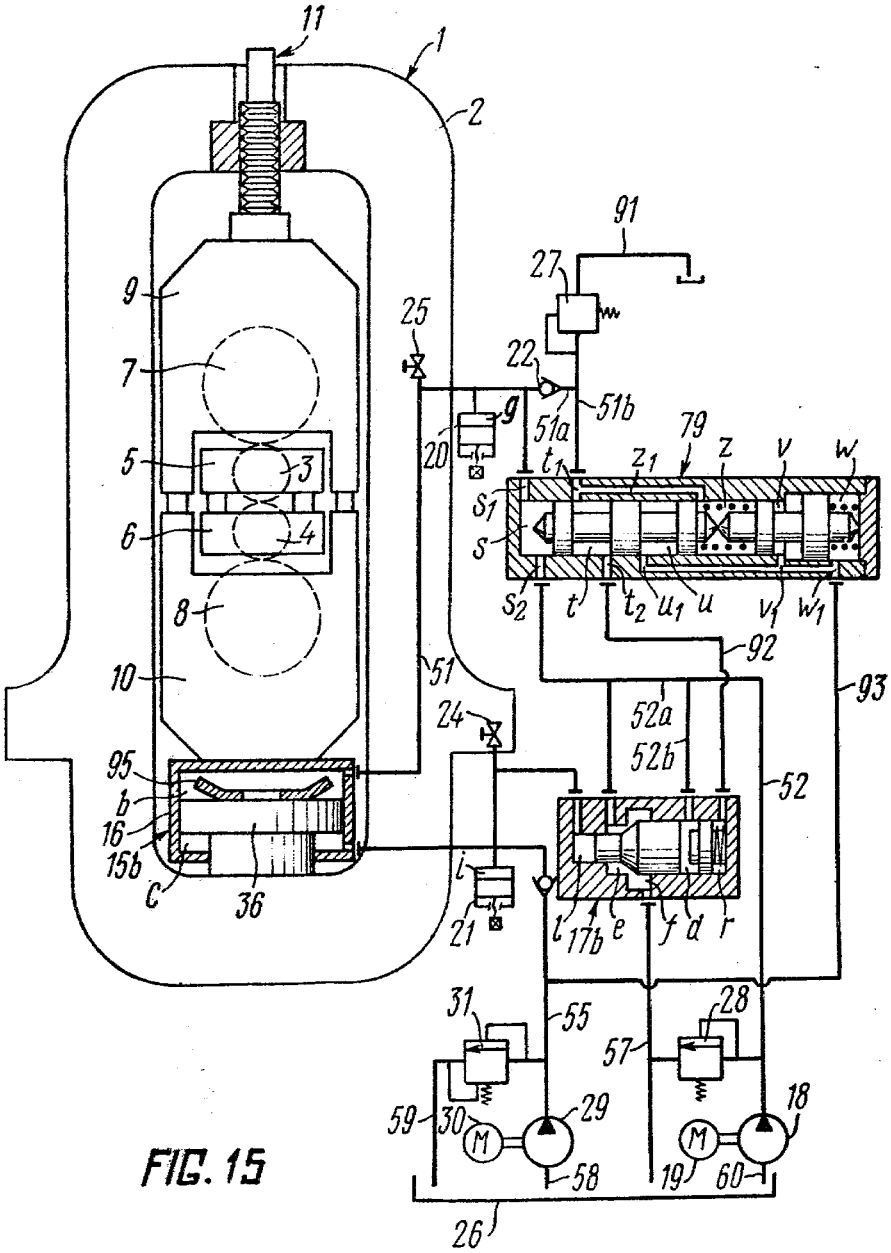
FIG. 15 is an elevational view of a roll mill stand as viewed from the operator's side, partially in section, showing the device for controlling the thickness of the strip stock being rolled between rolls, according to the invention, featuring the chamber of the hydraulic dynamometer being integrated with the piston-end space of the double-space hydraulic cylinder, and having a hydraulic piloted reversing spool valve.

An embodiment of the device as shown in FIGS. 15–17 differs from the device according to the second embodiment thereof as seen in FIG. 7 in that the chamber "a" of the hydraulic dynamometer 14 is combined with the space "b" of the double-space hydraulic cylinder 15 (FIG. 15) which substantially adds to the simplicity of the device.

With a view to automatically engaging said device in operation, a hydraulically piloted reversing spool valve 79 is incorporated into the circuit thereof. For the same reason the construction of the valve 17 and of the double-space hydraulic cylinder 15, as well as hydraulic communication of the units of the device, are modified. The other units of the device, viz., the pumping units 18 and 29 with the motors 19 and 30, the volumetric oil regulators 20 and 21, the valves 27 and 31, the pressure relief valve 28, the check valves 22 and 23, the stop valves 24 and 25 and the tank 26 remain the same, perform the same functions as in the second embodiment and bear the same reference numerals.

As to the hydraulic cylinder 15*b* and the valve 17*b* whose construction is partially modified, their components, spaces, chambers and ports which perform the same functions as in the second embodiment of the device are indicated with the same reference numerals but followed by other indexes.

The valve 17*b* (FIG. 16) comprises the casing 40*b* which accomodates the stepped sliding spool 41*b* having the step 63, a floating piston 80 loaded by a spring 81, and the cover 42*b* held to the casing 40*b* by the screws 43*b*.

The sliding spool 41*b* forms along with the casing 40*b* a control chamber which is subdivided into two subchambers "d" and "r" which communicate with the respective ports "$d_1$" and "$r_1$" made in the casing 40*b*. Along with the cover 42*b* the sliding spool 41*b* defines two chambers, i.e., the control chamber "l" communicating with the port "$l_1$" and the throttle chamber "e" communicating with the port "$e_1$", as well as the throttling gap "y". The drainback chamber "f" is established by the sliding spool 41*b* and communicates with the port "$f_1$" provided in the casing 40*b*.

The reversing spool valve 79 (FIG. 17) has a casing 82, wherein a sliding spool 83 loaded by a spring 84 and a plunger 85 loaded by a spring 86 which rests upon a cover 87 held to the casing 82 by screws 88, are coaxially mounted. On the side of the sliding spool 83, the reversible spool valve 79 is closed by a cover 89 held to the casing 82 by screws 90.

The sliding spool 83 defines along with the casing 82 and the cover 89 the chamber "s" communicating with the port "$s_1$". The sliding spool 83 and the the casing 82 define the annular chambers "t" and "u" communicating with the respective ports "$t_1$" and "$u_1$".

The plunger 85 defines, along with the casing 82, the annular chamber "v" and, along with the casing 82 and the cover 87, the chamber "w", both of said chambers intercommunicating through the respective ports "$v_1$" and "$w_1$" and communicating with the annular chamber "u" through the port "$u_1$".

The annular chamber "z" is defined between the sliding spool 83 and the plunger 85 and communicates with the chamber "t" by means of the ports "$z_1$" and "$t_1$".

The casing 82 of the reversible spool valve 79 is provided with the ports "$s_2$" and "$t_2$".

Hydraulic communication of the units of the device is effected as follows. The space formed by the piston-end space "b" of the hydraulic cylinder 15*b* (FIG. 15) and the chamber "g" of the volumetric oil regulator 20 communicates through the hydraulic piping 51 and the port "$s_1$" with the chamber "s", and through the check valve 22 and the hydraulic pipings 51*a* and 51*b* with the valve 27 and the annular chamber "t". The control chamber "d" and the throttle chamber "e" of the valve 17*b*, as well as the pumping unit 18 communicate through the hydraulic pipings 52*b*, 52*a*, 52 with the port "$s_2$" of the reversible spool valve 79 which is adapted to communicate with the chamber "s" during the rolling process. When no strip stock is between the rolls, the annular chamber "t" through the port "$t_1$" and the hydraulic pipings 51*b* and 91 communicates with the tank 26. The chamber "r" of the valve 17*b* communicates via hydraulic piping 92 with the port "$t_2$" which is adapted to communicate, during the rolling process, with the tank 26 through the annular chamber "t", the port "$t_1$" and the hydraulic pipings 51*b* and 91 and when no strip stock is between the rolls, said chamber "r" communicates through the annular chamber "u", the ports "$u_1$" and "$v_1$", hydraulic pipings 93 and 55 with the pumping unit 29 creating constant oil pressure. With the sliding spool 83 (FIG. 17) assuming the neutral position, the port "$t_2$" is closed and the chambers "v" and "w" communicate with the pumping unit 29 through the hydraulic pipings 93 (FIG. 15) and 55.

Hydraulic communication of the rest of the units of the device, such as the piston-rod space "c" of the hydraulic cylinder 15*b*, the chamber "i" of the volumetric oil regulator 21, the other control chamber "l" of the valve 17*b*, the drainback chamber "f", is similar to that described with reference to the second embodiment of the device (FIG. 7).

The device is adjusted for operation in the same way as in the device according to the second embodiment, the only difference residing in that the tension of the spring 84 (FIG. 17) is selected to be lower than that of the spring 86.

Initial pressure is built up in the units of the device by putting the pumping units 18 and 29 (FIG. 15) in operation, with the result that the pressure $q_o$ is developed in the space formed by the chambers "c", "i" and "l" of the pumping unit 29, the same pressure being established in the chambers "v", "w" and "u" of the reversing spool valve 79, as well as in the chamber "r" of the valve 17*b* and in the hydraulic pipings 55, 92, 93 communicating the pumping unit with said chambers. It should be noted in this connection that the plunger 85 (FIG. 17) is in the leftmost position so that its piston 94 thrusts against the casing 82. The sliding spool 83 is likewise in the leftmost position and thrusts against the cover 89.

The result is that the annular chamber "u" communicates the ports "$t_2$" and "$u_1$", the annular chamber "t" communicates the ports "$s_2$" and "$t_1$", and the pumping unit 18 (FIG. 15), the first control chamber "d" and the throttle chamber "e" of the valve 17b communicate with the tank 26 through the annular chamber "t", the hydraulic pipings 51b, 91 and the valve 27. The pressure $q_{ol}$ effective in said chambers and in the hydraulic pipings 52 and 52a, 52b is greater than atmospheric pressure, and is adjusted by the valve 27. The same pressure is developed in the spaced defined by the chambers "b", "g" and "s", the amount of pressure being selected obeying to the following inequalities $$q_{ol} < \frac{P_1}{F_3} \tag{40}$$

where $P_1$ is the force exerted by the spring 84 (FIG. 17);

$F_s$ is the area of the end face of the sliding spool 83 in the chamber "s";

and $$q_{ol} < q_o \cdot \frac{F_c}{F_b} \tag{41}$$

where $F_c$ and $F_b$ are the areas of the hydraulic cylinder piston in its respective spaces "c" and "b".

The sliding spool 41b of the valve 17b is forced against the cover by the floating piston 80 being forced by the initial pressure $q_o$ effective in the chambers "1" and "r", the pressure $q_{ol}$ effective in the chambers "d" and "e", and by virtue of the tension of the spring 81 (FIG. 16).

The balanced state of the sliding spool 41b of the valve 17b can be expressed as follows $$q_o \cdot F_l + q_{ol} \cdot F_e + T - (F_r q_o + F) = 0 \tag{42}$$

From this one can find the force T with which the sliding spool 41b is pressed against the cover 42b

$$T = q_o \cdot (F_r - F_1) + F - q_{ol} \cdot F_e \tag{43}$$

where $F_r$ is the area of the floating piston 80 in the chamber "r".

As a result of the action of said force the amount of the gap "y" between the sliding spool 41b and the cover 42b equals zero.

The hydraulic cylinder piston rests through the spring 95 (FIG. 15) upon the bottom of the barrel 16, an oil layer being formed in between the ends of the piston 36 and the barrel 16. Thus, the bottom rolls 4 and 8, which rest by means of the chock 10 upon the barrel 16 of the hydraulic cylinder 15b, are locked in a definite position.

The required gap between the work rolls 3 and 4 is set by the pressure screw 11.

The device operates as follows.

As soon as the strip stock enters the rolls of the mill stand 1, the rolling force arises, whereby the components of the mill stand 1 and the double-space hydraulic cylinder 15b are subject to strain.

The result is a pressure increase in the piston-end space "b" due to the ends of the piston 36 and the barrel 16 being brought together which also results in an oil pessure increase in the chamber "s" of the reversing spool valve 79.

Once the pressure has reached the value q in the piston-end space "b" of the hydraulic cylinder 15b

$$q_o > q > (P_1/F_s) \tag{44}$$

the sliding spool 83 (FIG. 17) is urged away from the cover 89, thus communicating the port "$s_2$" with the chamber "s". At the same time the port "$t_2$" is closed, whereby the piston-end space "b" of the double-space hydraulic cylinder 15b (FIG. 15) communicates with the pumping unit 18 and with the chambers "d" and "e" of the valve 17b. This causes a pressure increase in the pumping unit 18, as well as in the piston-end space "b" of the hydraulic cylinder 15b and in said chambers of the valve 17b. Since the gap "y" equals zero, no oil flows from the throttle chamber "e" into the drainback chamber "f".

At a pressure of the pumping unit equal to $q > q_o$ the slidind spool 83 (FIG. 17) along with the plunger 85 is urged to travel to the rightmost position so that the plunger thrusts against the cover 87, the sliding spool 83 thrusts against the plunger 85 and the chamber "r" of the valve 17b communicates with the tank 26 (FIG. 15) through the port "$t_2$" and the annular chamber "t".

The piston 80 (FIG. 16) of the valve 17b moves away from the sliding spool 41b to thrust against the bottom of the drilling in the casing 40b and the sliding spool 41b of the valve 17b is forced against the cover 42 by the force $$T = q(F_3 - F_3) - q_o \cdot F_l \tag{45}$$

where $F_d$, $F_e$ and $F_l$ are the areas of the sliding spool 41b in the chambers "d", "e" and "l", respectively, of the pressure valve 17b.

That is why the throttling gap "y" is closed and no oil flows therethrough to thee oil tank 26 (FIG. 15).

A pressure increase of the pumping unit 18 occurs until the force R, created under the effect of the pressure q produced by the pumping unit, urges the barrel 16 to move with respect to the piston 36, while part of the force R, developed by the hydraulic cylinder 15b under the effect of the pressure in the piston-end space "b", offers resistance to the rolling force P, and the difference between the force R and the rolling force P is effective in an enclosed space formed by the chambers "c", "i", "l".

The barrel 16 begins to move under the following conditions $$R - P > q_o \cdot F_c \tag{46}$$

Thus, the oil pressure therein rises due to said enclosed space being reduced.

As soon as the sliding spool 41b (FIG. 16) of the valve 17b becomes balanced by the oil pressure effective in the chambers "d", "è" and "l", the gap "y" between the sliding spool 41b and the cover 42b opens so that the oil delivered by the pumping unit 18 (FIG. 15) is free to completely flow from the throttle chamber "e" through the gap "y" to the drainback chamber "f" and therefrom to the oil tank 26, whereby the barrel 16 of the hydraulic cylinder 15b stops moving.

The amount of movement by the barrel 16 is equal to $$\delta h_2 = \frac{Q - Q_o}{k_1} = \frac{\Delta Q}{k_1} \tag{47}$$

Taking into account this amount of movement the total change of the strip stock thickness equals $$\Delta h = \frac{\Delta R - \Delta Q}{k} - \frac{\Delta Q}{k_1} \quad (48)$$

while the outgoing thickness of the strip stock is equal to $$h_1 = h_o + \frac{2q_o \cdot F_a - G}{k} + \frac{\Delta R - \Delta Q}{k} - \frac{\Delta Q}{k_1} \quad (49)$$

When realizing relation (16) between the stiffness factors $k_1$ and k, the right-hand member of equation (48) equals zero, therefore no change of the roll gap and hence of the outgoing strip stock thickness due to deformation of the roll mill stand occurs.

Upon discharging the strip stock from the rolls the device resumes the initial position to be ready for the next operating cycle.

Thus, the specific object of the invention aimed at increasing the accuracy of control and effecting a less expensive and simpler device is achieved. This is so because the force causing the roll supports to move is changed in the course of the strip stock deformation between the rolls proportionately to the rolling force. For this purpose in a device for carrying into effect said method use is made of hydraulic dynamometers having their interior chamber fully filled with a fluid adapted for absorbing the rolling force. Valves for pressure control of said fluid have a control chamber communicating with the chamber of the hydraulic dynamometer and a throttle chamber communicating with a hydraulic cylinder and with the source of fluid.

We claim:

1. A device for controlling thickness of strip stock being rolled between rolls of a roll mill stand including a roll housing on which a screwdown arrangement is mounted, mill rolls with supports accommodated in side recesses of said roll housing for at least a movable roll of the rolls to move in the direction of action of a rolling force, said device consisting of two portions situated on both sides of the roll mill stand and being similarly made, each portion comprising: a hydraulic dynamometer interposed between said supports of one of said work rolls and said roll mill stand housing to absorb the rolling force; at least one hydraulic cylinder provided between said supports of one of said rolls and said roll mill stand housing, a piston-end space of said hydraulic cylinder communicating with a source of power fluid under pressure to build up an adjusting force greater in magnitude than the rolling force, the difference between said forces being large enough for said movable roll and the supports to move in the course of rolling; elastic members to determine the position of said supports of said movable roll and to create a balancing force preventing said supports from being brought together and so positioned as to absorb the difference between the adjusting force and the rolling force, the adjusting force offering resistance to the rolling force and deforming said elastic members of the device, the ratio between a stiffness factor of said elastic members of the device and a stiffness factor of the roll mill stand being predetermined; a valve for regulating the pressure of power fluid effective in a piston-rod space of said hydraulic cylinder, comprising: a casing, a sliding spool accommodated in said casing to define a control chamber communicating with a chamber of said hydraulic dynamometer to form an enclosed fluid-filled space and a throttle chamber communicating with said piston-rod space of said hydraulic cylinder and with the source of power fluid to form an enclosed space for running power fluid.

2. A device as claimed in claim 1, wherein each of said hydraulic cylinders comprises a cylinder barrel, a cover, a piston and a piston-rod defining said piston-rod space, said piston-rod space being filled with power fluid and forming, along with said components of said hydraulic cyliner defining said space, the elastic members of said device to provide for a required magnitude of the adjusting force.

3. A device as claimed in claim 2, wherein said sliding spool of each of said valves is stepped to define an additional control chamber communicating with the piston-rod space of said hydraulic cylinder to establish an enclosed space for running power fluid.

4. A device as claimed in claim 3 further comprising a regulator having an interior communicating with the piston-rod space of said hydraulic cylinder to form an enclosed space filled with power fluid, said piston-rod space and said fluid being elastic members of the device.

5. A device as claimed in claim 2, wherein a spring is provided in the piston-rod space of said hydraulic cylinder, said spring resting with its ends upon the piston and cover of said cylinder, said spring forming, along with said power fluid and the components of said hydraulic cylinder, the elastic members of the device.

6. A device as claimed in claim 5, further comprising a regulator having an interior communicating with the piston-rod space of said hydraulic cylinder to form an enclosed space filled with power fluid, said piston-rod space and said fluid being elastic members of the device.

7. A device as claimed in claim 2, further comprising a spring located in the piston-rod space of said hydraulic cylinder, said piston-end space communicating during the rolling process with the control and throttle chambers of said valve, said spring resting, when no strip stock is between the rolls of the mill stand, upon the piston and barrel of said hydraulic cylinder to prevent the supports of the rolls from being brought apart.

8. A device as claimed in claim 7, further comprising a regulator having an interior communicating with the piston-rod space of said hydraulic cylinder to form an enclosed space filled with power fluid, said piston rod space and said fluid being elastic members of the device.

9. A device as claimed in claim 2, further comprising a regulator having an interior communicating with the piston-rod space of said hydraulic cylinder to form an enclosed space filled with power fluid, said piston-rod space and said fluid being elastic members of the device.

10. A device as claimed in claim 1, wherein said sliding spool of each of said valves is stepped to define an additional control chamber communicating with the piston-rod space of said hydraulic cylinder to establish an enclosed space for running power fluid.

11. A device as claimed in claim 10, further comprising a regulator having an interior communicating with the piston-rod space of said hydraulic cylinder to form an enclosed space filled with power fluid, said piston-rod space and said fluid being elastic members of the device.

12. A device as claimed in claim 10, wherein the piston-end space of said hydraulic cylinder communicates with the source of power fluid pressure through a directional-control sliding spool valve which has first and second control chambers, said first control chamber communicating during the rolling process with said throttle chamber of said valve, with the piston-end space of the hydraulic cylinder and with the source of power fluid pressure, said second control chamber communicating with the source of constant pressure.

13. A device as claimed in claim 1, wherein the chamber of said hydraulic dynamometer is combined with the piston-end space of said hydraulic cylinder.

14. A device as claimed in claim 13, further comprising a regulator having an interior communicating with the piston-rod space of said hydraulic cylinder to form an enclosed space filled with power fluid, said piston-rod space and said fluid being elastic members of the device.

15. A device as claimed in claim 13, wherein the piston-end space of said hydraullic cylinder communicates with the source of power fluid pressure through a directional-control sliding spool valve which has first and second control chambers, said first control chamber communicating during the rolling process with said throttle chamber of said valve, with the piston-end space of the hydraulic cylinder and with the source of power fluid pressure, said second control chamber communicating with the source of constant pressure.

16. A device as claimed in claim 1, wherein the piston-end space of said hydraulic cylinder communicates with the source of power fluid pressure through a directional-control sliding spool valve which has first and second control chambers, said first control chamber communicating during the rolling process with said throttle chamber of said valve, with the piston-end space of the hydraulic cylinder and with the source of power fluid pressure, said second control chamber communicating with the source of constant pressure.

* * * * *